US011431105B2

(12) United States Patent
Waldauer et al.

(10) Patent No.: US 11,431,105 B2
(45) **Date of Patent: *Aug. 30, 2022**

(54) MULTI-BAND FAST ROLL OFF ANTENNA HAVING MULTILAYER PCB-FORMED CLOAKED DIPOLES

(71) Applicant: John Mezzalingua Associates, LLC, Liverpool, NY (US)

(72) Inventors: Alex Waldauer, Syracuse, NY (US); Charles Buondelmonte, Baldwinsville, NY (US); Taehee Jang, Fayetteville, NY (US); Niranjan Sundararajan, Liverpool, NY (US); Evan Christopher Wayton, Tully, NY (US); Lance Bamford, Pittsford, NY (US)

(73) Assignee: John Mezzalingua Associates, LLC, Liverpool, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/328,636

(22) Filed: May 24, 2021

(65) Prior Publication Data

US 2021/0280985 A1 Sep. 9, 2021

Related U.S. Application Data

(63) Continuation of application No. 16/613,852, filed as application No. PCT/US2018/033250 on May 17, 2018, now Pat. No. 11,018,438.

(Continued)

(51) Int. Cl.
*H01Q 21/26* (2006.01)
*H01Q 21/06* (2006.01)
(Continued)

(52) U.S. Cl.
CPC ..... *H01Q 21/062* (2013.01); *H01Q 5/307* (2015.01); *H01Q 21/26* (2013.01); *H01Q 1/246* (2013.01); *H01Q 9/04* (2013.01); *H01Q 21/0025* (2013.01); *H01Q 21/20* (2013.01); *H01Q 21/30* (2013.01); *H01Q 23/00* (2013.01)

(58) Field of Classification Search
CPC ..... H01Q 21/062; H01Q 5/307; H01Q 21/26; H01Q 21/0025; H01Q 23/00; H01Q 1/246; H01Q 21/30; H01Q 9/04; H01Q 21/20
See application file for complete search history.

(56) References Cited

U.S. PATENT DOCUMENTS 11,018,438 B2 * 5/2021 Waldauer ..... H01Q 9/285

* cited by examiner

*Primary Examiner* — Joseph J Lauture
(74) *Attorney, Agent, or Firm* — Barclay Damon LLP

(57) ABSTRACT

Disclosed is a telecommunications antenna having a plurality of cloaked low band (LB) and high band (HB) dipoles. The LB and HB dipoles provide cloaking by breaking the dipoles into dipole segments, and providing conductive cloaking elements over the gaps between dipole segments to form a plurality of capacitors along the dipole. The capacitors along the LB dipoles provide a low impedance to LB RF signals and a high impedance to HB signals. The capacitors formed on the HB dipoles provide a low impedance to RF signals and high impedance to harmonics of the LB RF signals. This cross-cloaking of dipoles enables more dense arrangements of LB and HB dipoles on an antenna array face, providing opportunities to arrange, for example, the LB dipoles with an array factor that results in an advantageous fast roll off gain pattern.

33 Claims, 21 Drawing Sheets

Related U.S. Application Data

(60) Provisional application No. 62/507,936, filed on May 18, 2017.

(51) Int. Cl.

| | |
|---|---|
| ***H01Q 5/307*** | (2015.01) |
| *H01Q 21/00* | (2006.01) |
| *H01Q 23/00* | (2006.01) |
| *H01Q 1/24* | (2006.01) |
| *H01Q 21/30* | (2006.01) |
| *H01Q 21/20* | (2006.01) |
| *H01Q 9/04* | (2006.01) |

NOTES:

1) FABRICATE PCB IN ACCORDANCE WITH IPC-6012C,CLASS2; PER IPC-6011 USING JMA WIRELESS SUPPLIED DATA FILES FOR_3_-LAYER PCB.
2) LINE WIDTH TOLERANCES ± .005" FOR 0.5 OZ FINISHED CU; ± .001" FOR 1.0 OZ FINISHED CU
3) FINISH REQUIREMENTS PLATE ALL EXPOSED COPPER SURFACES.
   _X_ 3.1 PLATED COPPER (IMMERSION TIN)
   ____ 3.3 GOLD PLATED AREA SHOWN ON DRAWING(THICK GOLD)
4) THIS BOARD IS DESIGNED FOR SMT
   ____ YES _X_ NO
5) DESMEAR SHALL BE PERFORMED ON ALL PLATED THROUGH HOLES TO ENSURE RELIABLE PLATING
6) ETCHBACK TO BE .010" MINIMUM.
7) SOLDIER MASK REQUIREMENTS
   _X_ EMP-110HD UV CURABLE SOLDER MASK 0.0007" - 0.00015" THICK _X_ L1 LAYER;
   ____ CLEAR TEFLON LOADED SOLDER MASK 0.0007" THICK ___ TOP SIDE ___ BOTTOM SIDE
   ____ (LP) VIAS PLUGGED/TENTED/(NONE/ALL/SELECTED) _X_ NOT REQUIRED
   WHEN APPLICABLE, ANNULAR RING CLEARANCE AROUND PAD/ LAND SHALL BE 0.0005" WITH NO EXPOSED TRACES.
8) MARKING REQUIREMENTS
   REQUIRED; WHITE COLOR SILKSCREEN ON L1 (TOP) AND L ___ (BOTTOM) _X_ NOT REQUIRED
9) CONTINUITY/SHORT TESTING REQUIREMENTS:
   ___ REQUIRED _X_ NOT REQUIRED
   IF REQUIRED, THE PCB SHALL BE ELECTRICALLY TESTED FOR SHORT CIRCUITS AND OPEN CIRCUITS BY THE PCB MANUFACTURER.THE MANUFACTURER SHALL PROVIDE THE CERTIFICATE OF THE TEST RESULTS TO IMA WIRELESS; ONE CERTIFICATE PER LOT IS REQUIRED
10) ROUTE STOPS TO BE OUTSIDE OF UNMASKED AREA. ROUTE PWB AS SHOWN IN BREAKAWAY TAB/ ROUTE DETAIL "B" (IF APPLICABLE).
11) THIS PCB IS TO BE PANELED UP:
   ___ YES _X_ NO
   IF REQUIRED, PANELING WILL BE IN ACCORDANCE WITH A SEPARATE SHEET INCLUDED IN THIS DRAWING OR A ONE-UP PCB OUTLINE VIEW WITH SEPARATE PANEL RAILS ADDED.
12) UL FLAMMABILITY MARKETING
   ___ YES _X_ NO
   IF REQUIRED, PCB MANUFCTURER MUST MARK THE BOARD(S) WITH "94V-0" TO INDICATE MATERIAL USED MEETS THE UL FLAMMABILITY SPECIFICATION MARKING PROCESS TO BE IN THE LAYER 1 (TOP SIDE) SILKSCREEN IN A CONSPICUOUS LOCATION.
13) MARK SUPPLIER ID AND DATE OF MANUFACTURE WHERE SHOWN
14) MARK CURRENT REVISION IN LOCATION SHOWN
15) GROUNDING VIAS SHOWN BUT NOT DIMENSIONED
   ___ YES _X_ NO
16) SUPPLIER TO GENERATE, NAME, AND FORWARD TO JMA THE GERBER FILES PER THE INFORMATION LIST TABLE.
17) MATERIAL REQUIREMENTS
   NOTE COPPER: (OVERALL PCB THICKNESS: SEE LAYERING STRUCTURE DETAIL "A")
   DIELETRIC SEPARATION BETWEEN THE LAYERS SHALL BE CONSISTENT WITH OVERALL PWB THICKNESS FOR CLASS 2 PCBS WHEN THEY ARE NOT SPECIFICALLY DEFINED IN THE LAYER STACK-UP DETAIL "A"

L1-L2 CORE
   _X_ RO4534
      LAMINATE _X_ 0.0327" (0.831mm) ___ 0.0407"
      COPPER _X_ 0.50 Oz [18mm] ____ 1.0 Oz [35mm]

L2-L3 CORE
   2X ROGERS BOND-PLY 2929
      LAMINATE X 0.0020" (0.508mm)
      COPPER _X_ 0.50 Oz [18mm] ____ 1.0 Oz [35mm]

FIG. 10

| REV | ECO | DATE | LOC | DESCRIPTION |
|---|---|---|---|---|
| 01 | 72560 | 4/5/17 | - | RELEASE TO PRE-PRODUCTION |

DETAIL "A"

LAYERING STRUCTURE
(NOT TO SCALE)
SEE NOTES 7 AND 17

MULTI-BAND FAST ROLL OFF ANTENNA HAVING MULTILAYER PCB-FORMED CLOAKED DIPOLES

CROSS-REFERENCE TO RELATED APPLICATIONS

This application is a continuation of U.S. patent application Ser. No. 16/613,852 filed on Nov. 15, 2019, which is a National Application of International Application No. PCT/US18/33250, filed on May 17, 2018, which claims priority to U.S. Provisional Patent Application No. 62/507,936 filed on May 18, 2017. The entire contents of these applications are hereby incorporated by reference.

FIELD OF THE INVENTION

The present invention relates to wireless communications, and more particularly, to a dipole configuration and structure that enables a compact spatial relationship between antenna elements having different bands and that minimize interference due to re-radiation.

There is considerable market demand for cellular antennas that operate in multiple bands and at multiple orthogonal polarization states to maximize antenna diversity. A solution includes the use of two orthogonal polarization states in both the low band (LB) (e.g., 496-690 MHz) and at two independent channels in each of two orthogonal polarization states in the high band (HB) (e.g., 1.7-3.3 GHz). There is further demand for the antenna having minimal wind loading, which means that the profile drag must be minimized by reducing the cross sectional area to oncoming wind. Another demand involves a fast roll-off gain patterns in both the high and low band frequencies. Conventional antennas have a gain pattern with considerable side and rear lobes. With these antennas mounted on a cell tower, each covering a different sector, the side and rear lobes of their respective gain patterns overlap, causing interference in the overlapping gain regions. Therefore, it is desirable for an antenna to have a fast roll-off gain pattern, wherein beyond a given angle (e.g., 45 degrees or 60 degrees), the antenna gain pattern falls off rapidly, thereby minimizing overlapping gain patterns for multiple sector antennas mounted on a single cell tower.

The foregoing can result in conflicting objectives inasmuch as the best way to achieve a fast roll-off gain pattern is to broaden the face of the antenna. However, it will be appreciated from the above discussion in connection with wind loading, such broadening of the antenna face will increases the profile drag and the associated wind loading. Conversely, the more closely dipoles are spaced on a single array face, the more interference is generated such that transmission in either the high band and harmonics of the low band is respectively picked up by the dipoles of the other band, causing coupling and re-radiation that contaminates the gain pattern of the transmitting band. This problem can be solved with dipoles that are designed to be "cloaked", whereby they radiate and receive in the band for which they are designed yet are transparent to the other band that is radiated by the other dipoles sharing the same compact array face.

Further, there are problems in using conventional PCBs and PCB technology in RF and antenna element applications, due to the fact that conventional PCBs are not meant to be used as a dielectric for RF propagation. First, materials and dimensions for the different PCB layers must have consistent and stable dielectric properties. Further, conventional approaches to connecting to metal layers buried within, or sandwiched by, PCB layers involves the use of plated through holes. This is where a hole is drilled through multiple layers after lamination and then plated so that the metal on each individual layer can be electrically connected. For DC connections, plated through holes have proven to be a viable method for connecting to buried metal layers. However, for RF circuitry, they present the following deficiencies.

First, all plated through holes create an interface layer between the copper plating within the barrel of the hole and the copper foil at the metal layers. Typically, this interface is inconsequential for DC connections. However, for RF circuitry, this interface can potentially create non-linearity in the circuit, which can cause passive intermodulation (PIM) and/or act as a potential reflection site (which can increase return loss).

Second, the plated metal within the barrel of a plated through hole can be very rough. Unlike the metal foil, which can be treated to decrease roughness, no secondary treatment is available for plated through holes. This roughness has typically no noticeable impact on DC current. However, RF current, especially at the higher frequencies, tends to travel along the outer surface of the metal. The increased roughness will increase the loss as the RF current travels through the plated through hole.

Third, RF circuitry requires consistent coupling with a ground layer in order to maintain the appropriate impendence. Plated through holes do not have coupled ground planes and impedance matching through a plated through hole has historically been very difficult, or often, impossible.

Finally, plated through holes are expensive because they require copper plating. Accordingly, what is needed is an antenna that has LB and HB dipoles of a specific design, placement, and spacing that provides for sufficient antenna diversity, minimal wind loading, and a fast roll-off gain pattern. These dipoles must provide for mutual cloaking so that they do not suffer from gain contamination due to coupling and re-radiation by the dipoles of the counterpart band. Further, the LB and HB dipoles must be physically robust, easy to manufacture, have consistent and predictable dielectric properties, and have strong RF performance with minimized PIM and return loss effects.

SUMMARY OF THE INVENTION

In an aspect of the present invention, a cloaked high band dipole for an antenna is provided. The cloaked high band dipole has a first PCB layer; a first metal layer disposed on a first side of the first PCB layer, the first metal layer formed into a plurality of capacitive feeds; a second metal layer disposed on a second side of the first PCB layer, the second metal layer arranged in a plurality of dipole segments, each adjacent dipole segment separated from each other by a gap; a second PCB layer disposed on the second metal layer; and a third metal layer disposed on the second PCB layer, the third metal layer arranged as at least one cloaking element, wherein the cloaking element overlaps two adjacent dipole segments, forming a capacitor with the second PCB layer that creates a low impedance coupling between the two adjacent dipole segments at a high band frequency.

In another aspect of the present invention, a cloaked low band dipole is provided. The cloaked low band dipole has a first sub dipole oriented along a first axis, the first sub dipole having a first plurality of dipole segments that are disposed on a first capacitor PCB layer, wherein adjacent dipole segments within the first plurality of dipole segments are separated by a first gap, wherein the first sub dipole has a plurality of first cloaking elements disposed on an opposite side of the first capacitor PCB layer from the plurality of dipole segments, each first cloaking element corresponding to a first gap, and wherein each first cloaking element is disposed such that it is superimposed over the corresponding first gap to form a capacitor between the first cloaking element, the first capacitor PCB layer, and the adjacent dipole segments corresponding to the first gap; and a second sub dipole oriented along a second axis, the second sub dipole having a second plurality of dipole segments that are disposed on a second capacitor PCB layer, wherein adjacent dipole segments within the second plurality of dipole segments are separated by a second gap, wherein the second sub dipole has a plurality of second cloaking elements disposed on an opposite side of the second capacitor PCB layer from the plurality of dipole segments, each second cloaking element corresponding to a second gap, and wherein each second cloaking element is disposed such that it is superimposed over the corresponding second gap to form a capacitor between the second cloaking element, the second capacitor PCB layer, and the adjacent dipole segments corresponding to the second gap, wherein one of the second dipole segments is coupled to a ground plane.

In another aspect of the present invention, a telecommunications antenna is provided. The telecommunications antenna has a plurality of high band dipoles, wherein the high band dipoles are configured to radiate RF energy between a first high band frequency and a second high band frequency, and wherein each of the high band dipoles has a high band multilayer PCB structure; and a plurality of low band dipoles, wherein the low band dipoles are configured to radiate RF energy between a first low band frequency and a second low band frequency, wherein each of the low band dipoles has a low band multilayer PCB structure, wherein each of the plurality of high band dipoles has a plurality of high band dipole segments that are configured to be capacitively coupled to have a low impedance between the first high band frequency and the second high band frequency, and to have a high impedance between the first low band frequency and the second low band frequency and their harmonics, and wherein each of the plurality of low band dipoles has a plurality of low band dipole segments that are configured to be capacitively coupled to have a low impedance between the first low band frequency and the second low band frequency, and to have a high impedance between the first high band frequency and the second high band frequency.

The foregoing and other features of the disclosure will be more readily understood and fully appreciated from the following detained description, taken in conjunction with the accompanying drawings.

DESCRIPTION OF EXEMPLARY EMBODIMENTS

Figure 1A:
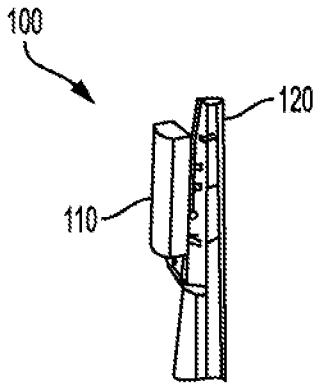
FIG. 1*a* is a simplified illustration of an exemplary antenna mounted on a tower.

FIG. 1*a* is a simplified illustration of an exemplary antenna deployment 100, including an antenna 110 that is mounted on a tower 120. Given that antenna 110 is elevated on a tower, it is exposed to potentially strong winds and severe weather. These factors drive a requirement that antenna 110 be designed to minimize wind loading, and thus minimize the stress induced on the tower and the mounting hardware holding antenna 110 to tower 120. A key factor in minimizing wind loading is the width of antenna 110, and thus the width of the array face (not shown) within antenna 110. Further, given the exposure to potentially extreme weather, the antenna elements (not shown) within antenna 110, along with all of the other materials within antenna 110, must be sufficiently robust not to degrade over time.

Figure 1B:
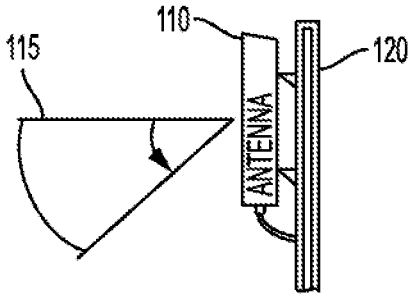
FIG. 1*b* illustrates the same antenna and tower, viewed from the side, along with a depiction of the plane of the pitch angle.

FIG. 1*b* illustrates antenna deployment 100, horizontally from the side. Depicted in FIG. 1*b* is the pitch angle plane 115. It is understood under the concepts of phased arrays and beamforming that by differentially phasing an RF signal to multiple vertically stacked antenna elements within antenna 110 it is possible to control the pitch angle of the beam emitted by antenna 110.

Figure 1C:
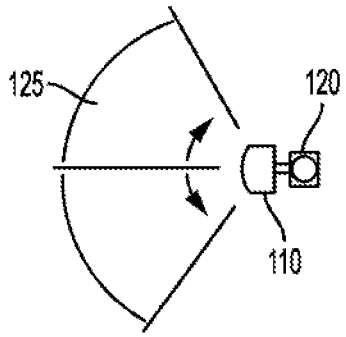
FIG. 1*c* illustrates the same antenna and tower, viewed downward from above, along with a depiction of the azimuth plane.

FIG. 1*c* further illustrates antenna deployment 100, viewed vertically downward. Depicted in FIG. 1*c* is the azimuth plane 125, which is orthogonal to the pitch angle plane 115. It is within the azimuth plane 125 that the azimuthal width gain pattern of antenna 110 is defined. It is important to control the azimuthal width of the gain pattern (or beam) of antenna 110 so that interference between different antennas on tower 120 (the different gain patterns of the antennas defining sectors) is minimized. Minimizing sector interference is accomplished by controlling the contour of the gain pattern of antenna 110 in the azimuthal plane 125. A "fast roll-off" gain pattern minimizes overlap between sectors and thus reduces interference between sectors. Antennas may be designed to have, for example, either a 60 degree fast roll-off, whereby the antenna gain sharply drops off at +/−60 degrees of azimuth from the array face of antenna 110, or +/−45 degree fast roll-off. It would be understood that control of the fast roll-off angle is a function of the width of the array face of antenna 110. Basically, the further the antenna elements in antenna 110 are spaced apart along a horizontal axis of array face of antenna 110, the greater the array factor, and thus the narrower the fast roll-off angle. Given the need to minimize wind loading, the challenge is to design the array face of antenna 110 that minimizes the width of the array face while maintaining a well-controlled fast roll-off angle (e.g., 60 degrees or 45 degrees).

Figure 1D:
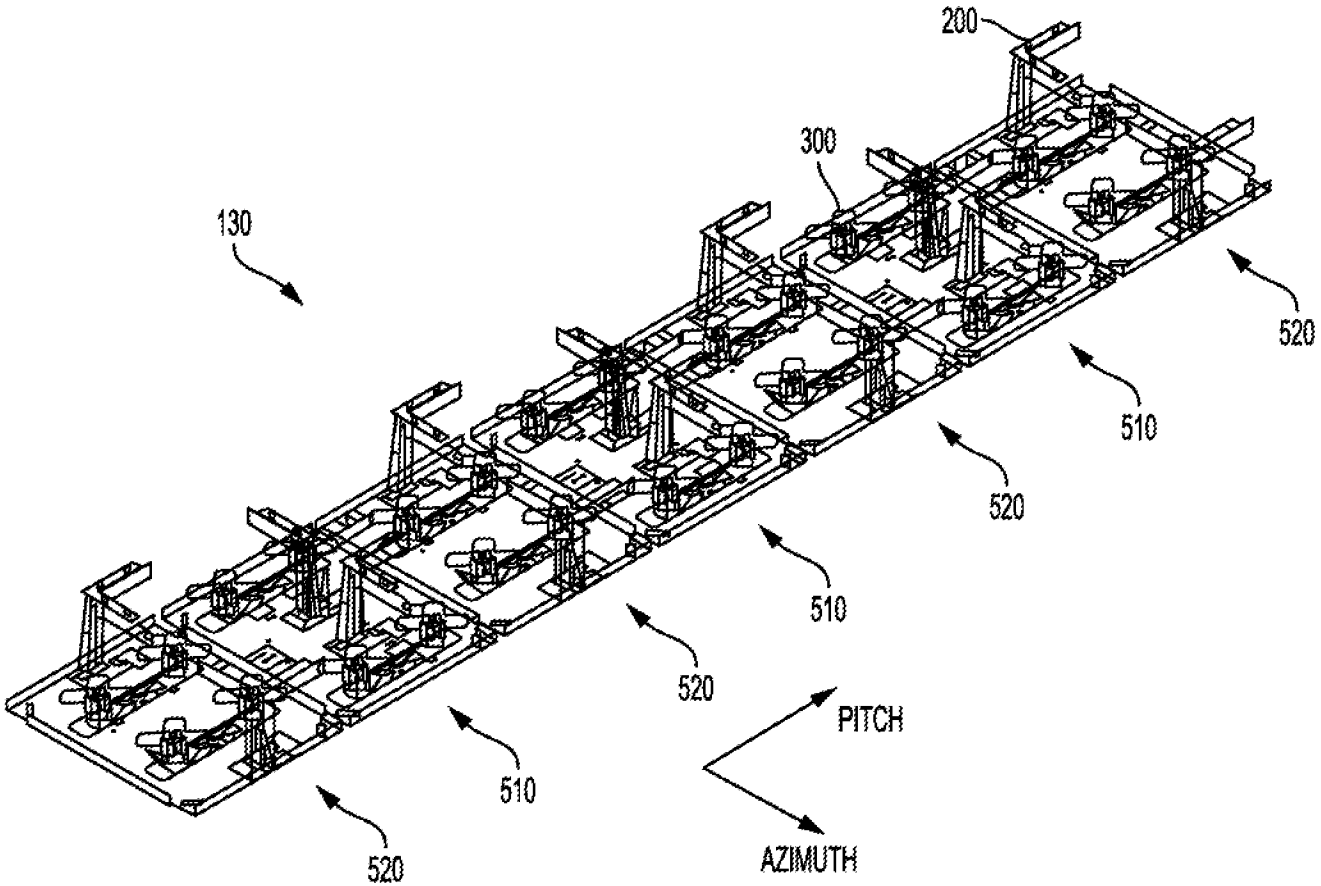
FIG. 1*d* is a cutaway view of an exemplary array face for the antenna.

FIG. 1*d* illustrates an exemplary array face 130 according to the disclosure. Shown in FIG. 1*d* are two axes: the pitch axis (which might otherwise be the x-axis) and the azimuth axis (which might otherwise be the y-axis). Referring to the pitch axis, increasing the number of antenna elements along the pitch axis increases the gain of the antenna 110. Given the use of an antenna 110 in a typical antenna deployment 100, although the tightness of the roll-off of the gain of antenna 110 is not as important as it is in the azimuth plane 125, it is typical for the gain pattern of antenna 110 to be steered vertically, along the pitch angle plane 125. This is done through the use of phase shifters not shown) that differentially alter the phase of the RF signal going to the antenna elements along the pitch axis, which controls the pitch angle of the center of the gain pattern of antenna 110. As illustrated, array face 130 comprises a plurality of unit cells 510 and 520, that are alternately arranged along the pitch axis. Each of the unit cells 510 and 520 have a plurality of low band (LB) dipoles 200 and high band (HB) dipoles 300. Each of these are explained in further detail below.

Figure 2A:
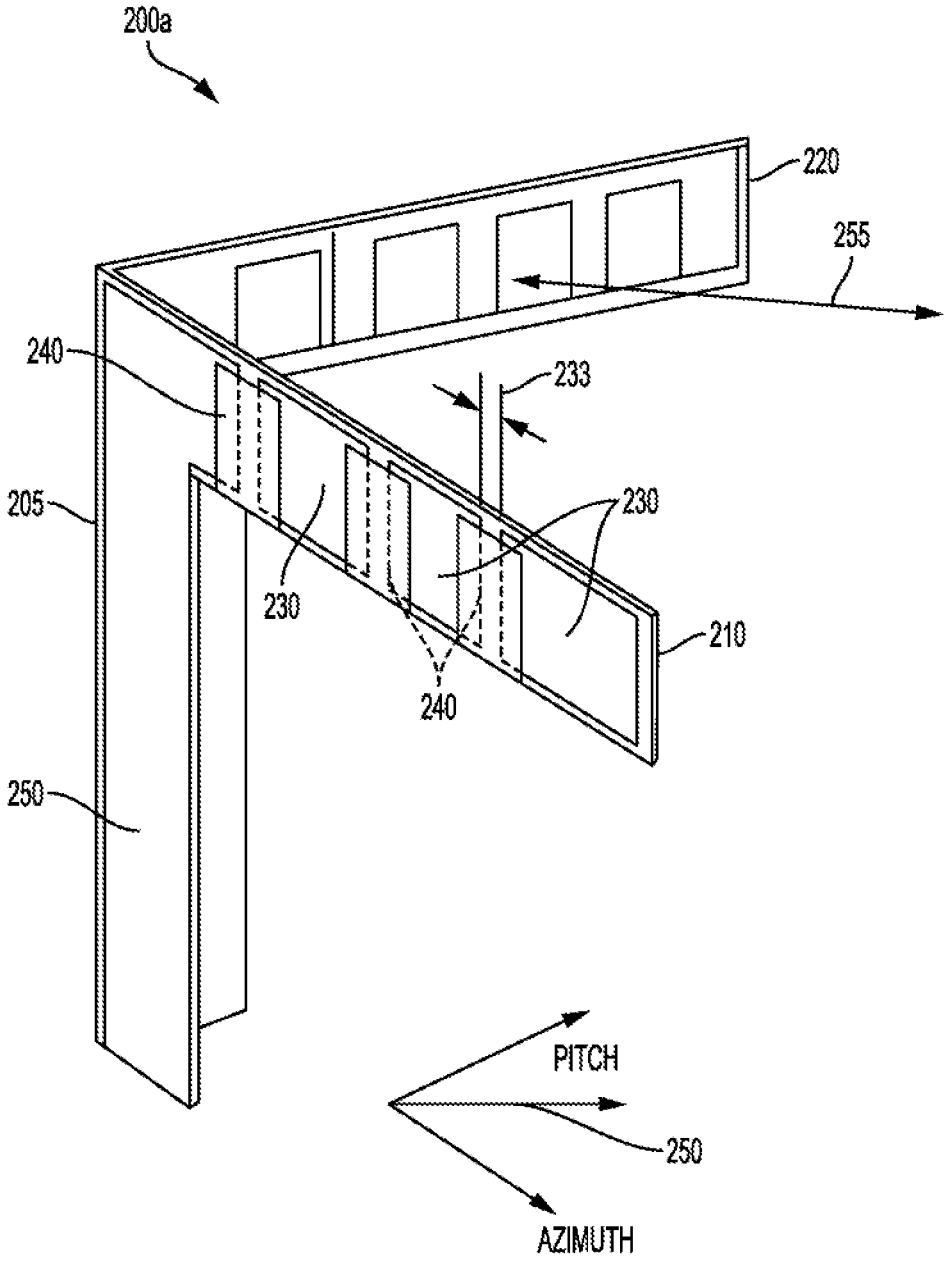
FIG. 2*a* illustrates an exemplary cloaked low band (LB) dipole that operates in a single polarization orientation.
Figure 2B:
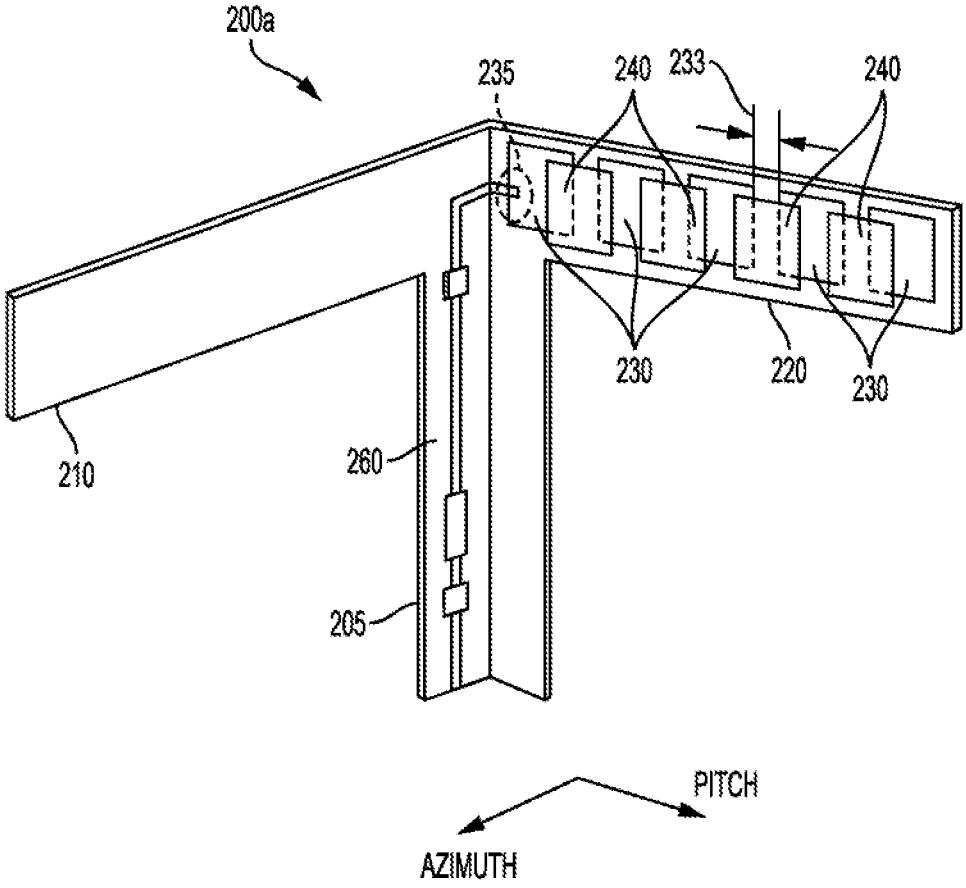
FIG. 2*b* illustrates the exemplary cloaked LB dipole from another angle.

FIGS. 2*a* and 2*b* illustrate an exemplary LB dipole 200. LB dipole 200 includes a base 205, an azimuth axis sub dipole 210, and a pitch axis sub-dipole 220, which are oriented at 90 degrees to each other. As might be inferred from their names, azimuth axis sub dipole 210 extends along the azimuth axis of array face 130, and pitch axis sub dipole 220 extends along the pitch axis. Both azimuth axis sub dipole 210 and pitch axis sub dipole 220 have a plurality of dipole segments 230 and a plurality of cloaking elements 240. LB dipole 200 may be configured such that the azimuth axis sub dipole 210 and the pitch axis sub dipole 220 collectively emit a field with a polarization orientation that is oriented at 45 degrees relative to both sub dipoles, along axis 255. Accordingly, LB dipole 200 may be referred to as a singular-polarized LB dipole. LB dipoles 200 come in two configurations: left-handed LB dipole 200*a*, and right-handed LB dipole 200*b*. This is described further with respect to FIG. 4.

As illustrated, azimuth axis sub dipole 210 has a plurality of metal dipole segments 230, which are spaced apart by a gap 233. The dipole segment 230 closest to the base is adjacent to a ground plane 250, which runs the length of base 205. Disposed over each gap 233 is a cloaking element 240, which may be located such that a centerline of gap 233 may be substantially aligned with a vertical line bisecting the corresponding cloaking element 240. More detailed information including exemplary dimensions of the components described here is provided below.

Referring to FIG. 2*b*, pitch axis sub dipole 230 may have a somewhat different dipole arrangement, known as a balun dipole, which is designed to balance the impedance of the ground plane 250 and dipole segments of azimuth axis sub dipole 210 with the dipole elements of pitch axis sub dipole 220. The balun dipole includes micro strip line 260 and dipole segments 230, which are separated by gap 233. Micro strip line 260 connects to the first dipole segment 230 through PCB access point 235. Because the dipole segments 230 are formed between two PCB layers of the multilayer PCB structure (described below), an access point 235 is milled into the PCB layer for direct solder access to the embedded metal layer of which the dipole segments 230 are formed.

The configuration of having cloaking elements 240 disposed over a gap 233 between dipole segments 230, with an intervening dielectric (not shown) disposed between them, results in a capacitively coupled circuit that, when excited with RF energy at a wavelength corresponding to the length of LB dipole 200, the gaps 233 between dipole segments 230 become substantially closed circuited through capacitive coupling, and the LB dipole 200 radiates RF energy at that wavelength. In other words, the impedance is low at the LB frequencies such that current flows substantially unabated through the capacitors formed by the dipole segments 230 and the cloaking elements 240. However, for HB RF energy impinging on LB dipole 200, the impedance created by the capacitors formed by dipole segments 230 and cloaking elements 240 is considerably greater at the HB frequencies, substantially preventing current from flowing in the LB dipole 200 at those frequencies. This will occur as long as the length of each of the dipole segments 230 is less than half the wavelength corresponding to the HB frequency. It is advantageous to have the length of each dipole segment 230 considerably shorter than that.

Figure 2C:
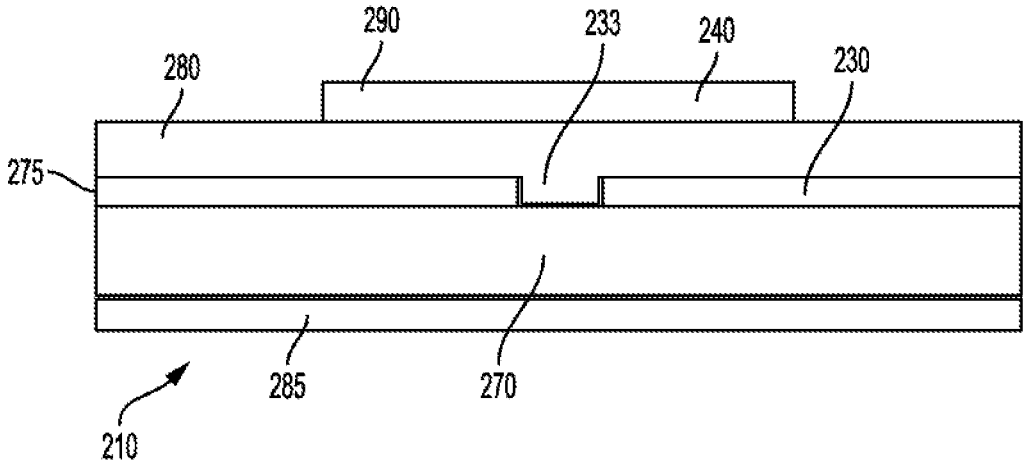
FIG. 2*c* illustrates an exemplary multilayer PCB structure for the azimuth axis LB subdipole.

FIG. 2*c* illustrates an exemplary multilayer PCB structure for the azimuth axis LB sub dipole 210. PCB structure has a first PCB layer 270. Disposed on an underside of first PCB layer 270 is a first metal layer 285. First metal layer 285 may be etched to form the micro strip line 260 illustrated in FIG. 2*b*. Disposed on the opposite side of first PCB layer 270 is second metal layer 275, which may be etched to form, for example, dipole segment 230, with gap 333 between them. Disposed on the opposite side of second metal layer 275 is a second PCB layer 280, which may at least partially fill gap 233 according to a process that is described below. Disposed on the opposite side of second PCB layer 280 is a third metal layer 290, which may be etched to form cloaking elements 240.

First PCB layer 270 may be formed of a material that has well a controlled dielectric constant and loss tangent, given that an antenna RF signal will be sustained in this material between first metal layer 285 and second metal layer 275, which corresponds respectively to the micro strip line 260 and the dipole segments 230 and outer dipole segments 325 of azimuth axis LB dipole 210. An example of such a material is Rogers R04534, having a thickness of 0.032 inches. First, second, and third metal layers (285, 275, and 290) may be formed of electro-deposited copper.

Second PCB layer 280 may be formed of a material that also has well controlled dielectric constant and loss tangent, given that it will sustain the antenna RF signal between the dipole segments 230 via capacitance formed by these dipole segments and cloaking segment 240. The material for the second PCB layer 280 should have an appropriate viscosity so that, when pressed against the combination of first PCB layer 270 and second metal layer 275 during fabrication, a portion of the material at least partly fills gap 233 between adjacent dipole segments 320. An example of such a material is a thermoplastic laminate, such as Cuclad and Isoclad, having a thickness of 0.002 to 0.004 inches. If the thickness of second PCB layer 280 is greater than 0.004 inches, then the RF performance of the dielectric diminishes. If the thickness of second PCB layer 280 is less than 0.002, then any structure formed of second metal layer 275 may "show through" second PCB layer 280 and distort the upper surface of second PCB layer 280. As a rule of thumb, the thickness of second PCB layer 280 should be at least twice the thickness of second metal layer 275. Use of a laminate for second PCB layer 940 works provided that the first PCB layer 910 is of a material with sufficient rigidity to support the dipole structure, such as RO4534.

First metal layer 285, second metal layer 275, and third metal layer 280 may be formed of electro-deposited copper, and have a thickness of substantially 0.0007 inches.

Figure 2D:
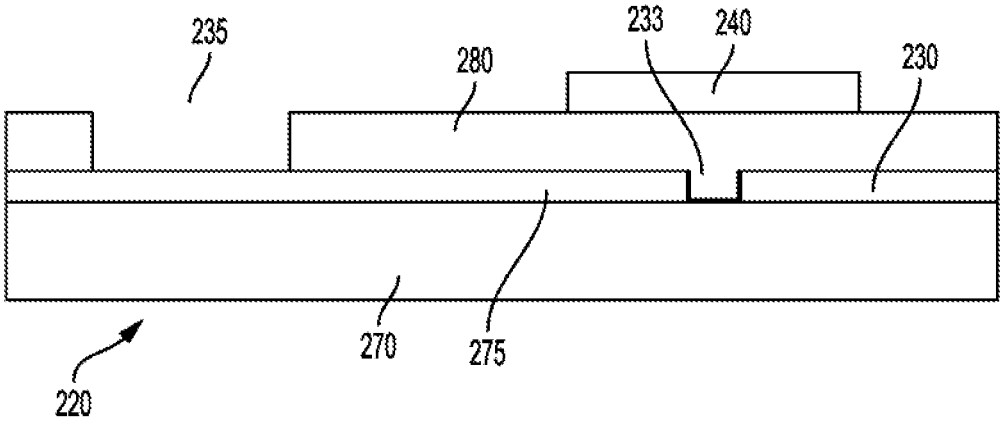
FIG. 2*d* illustrates an exemplary multilayer PCB structure for pitch axis LB sub dipole.

FIG. 2*d* illustrates an exemplary multilayer PCB structure for pitch axis LB sub dipole 220. The first PCB layer 270 and second PCB layer 280 may be the same as those described with respect to FIG. 2*c*. One difference is that the exemplary configuration of pitch axis LB sub dipole 220 described above does not have a first metal layer. Another difference is that the second PCB layer 280 has an access point 235, which may be milled out of (or otherwise formed in) in the PCB material. Access point 235 enables direct solder contact with second metal layer 275, which in this case is the contact from micro strip line 260, which is formed of the first metal layer 285 of the azimuth axis LB sub dipole 210.

Note that FIGS. 2*c* and 2*d* are not necessarily to scale. For example, gaps 233 may be of the same or similar width, although they are respectively illustrated in the two figures as being of different widths. Same is true for FIG. 2*d*, whereby the illustrated widths of gap 233 and access point 235 may be of different relative dimensions than as illustrated.

Figure 3A:
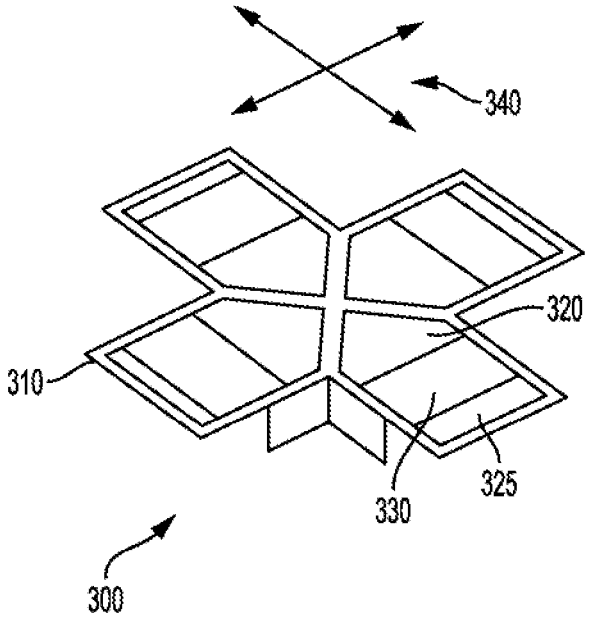
FIG. 3*a* is a simplified illustration of an exemplary cloaked high band (HB) dipole that operates in two orthogonal polarization orientations.

FIG. 3*a* is a simplified illustration of an exemplary HB dipole 300. HB dipole 300 includes a substrate 310, a plurality of inner dipole segments 320, and a plurality of outer dipole segments 325, each of which are adjacent to a corresponding inner dipole segment 320 and separated by a HB dipole gap (not shown), which is covered by a cloaking element 330.

In operation, a given combination of inner dipole segment 320 and outer dipole segment 325, and a corresponding combination opposite of it, functions as a HB dipole that radiates RF energy in one polarization orientation 340. At 90 degrees to that configuration of dipole segments is the other set of inner dipole segments 320, outer dipole segments 325, and the corresponding segments opposite of it, which radiates RF energy in a polarization orientation 340, orthogonal to the first. Accordingly, HB dipole may be referred to as a dual polarized HB dipole.

By dividing the HB dipole 300 into an inner dipole segment 220 and an outer dipole segment 325, with gap 333 between them, and having a cloaking element 330 disposed over gap 333 with an intervening dielectric layer (not shown) between the cloaking elements and the inner and outer dipole segments 320, 325, the configuration forms a capacitor. At HB frequencies, the impedance formed by the capacitor is such that the HB dipole is substantially the same as a continuous conductor. Conversely, at LB frequencies and their harmonics, the impedance is such that the capacitor forms an open circuit, and current is abated, preventing coupling and re-radiation at those frequencies. This effectively prevents RF coupling and re-radiation of LB harmonics by the HB dipole 300.

Figure 3B:
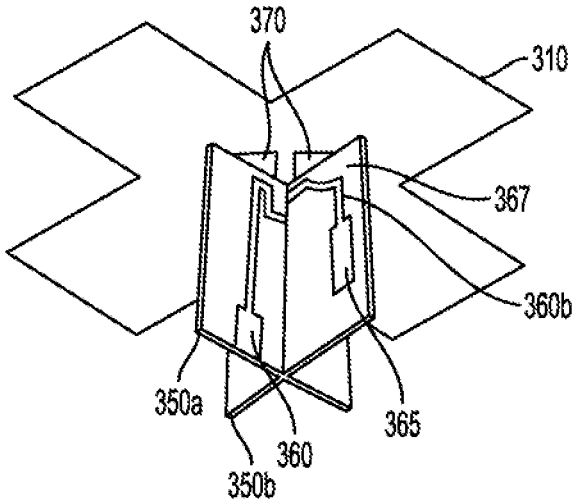
FIG. 3*b* illustrates the exemplary cloaked HB dipole from below.

FIG. 3*b* illustrates HB dipole 300 from below, which includes HB dipole stem 350. HB dipole step 350 includes a first polarization HB dipole stem plate 350*a*, and a second polarization HB dipole stem plate 350*b*, each of which may be configured with notches to enable them to be interlocked at a 90 degree orientation to each other. Each HB stem plate 350*a*, 350*b*, has disposed on it a corresponding balun micro strip line 360, each having a balun hairpin configuration 367, and an open circuit termination 365. Disposed on the opposite side of each HB step plate 350*a* and 350*b* is a corresponding ground plane (not shown), each of which are coupled to a capacitive feed 370, which is disposed on the underside of substrate 310. Many of these elements are described further with respect to FIGS. 9*a*-9*d*.

Figure 4:
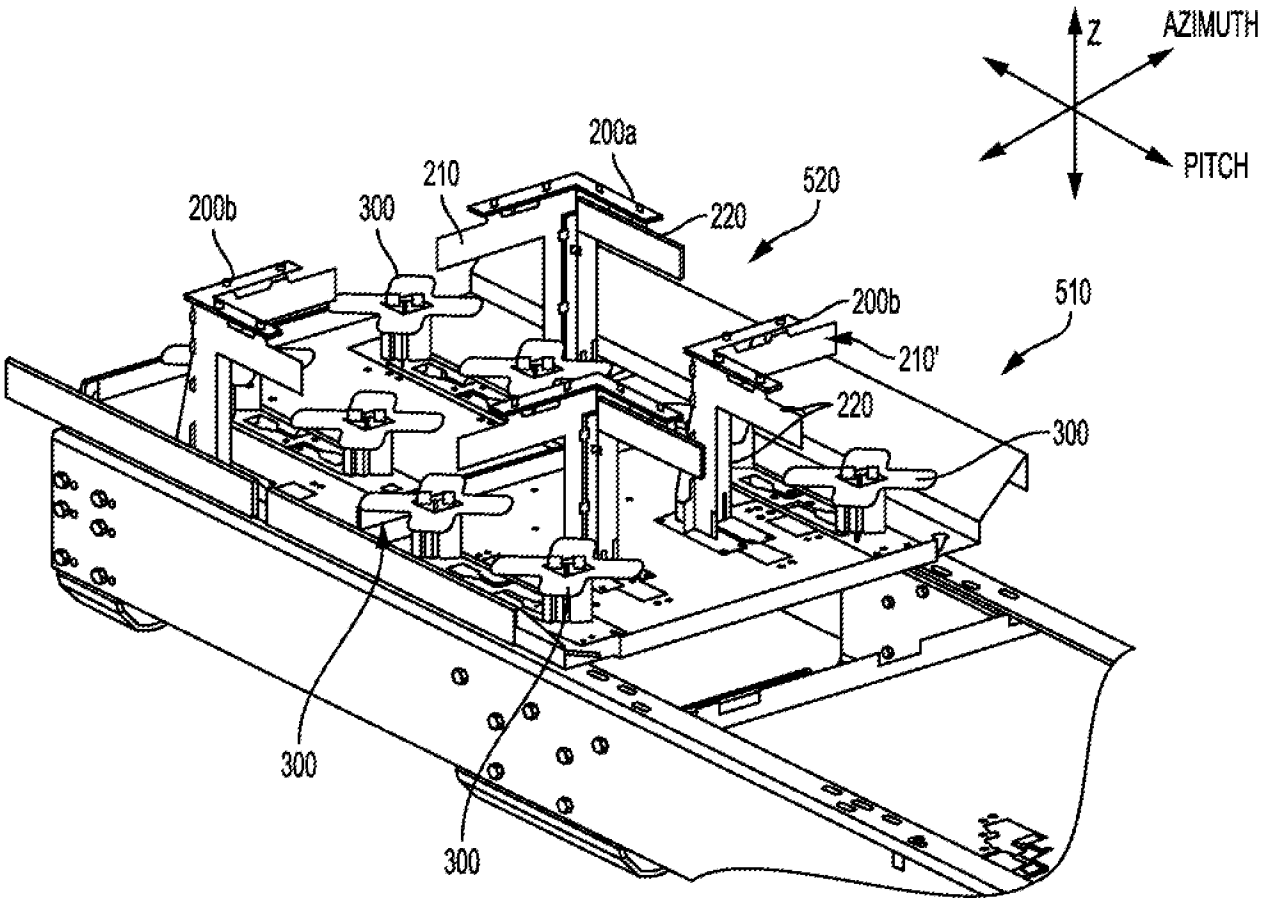
FIG. 4 is a partially broken-away perspective view of an exemplary antenna according to the disclosure.
Figure 5A:
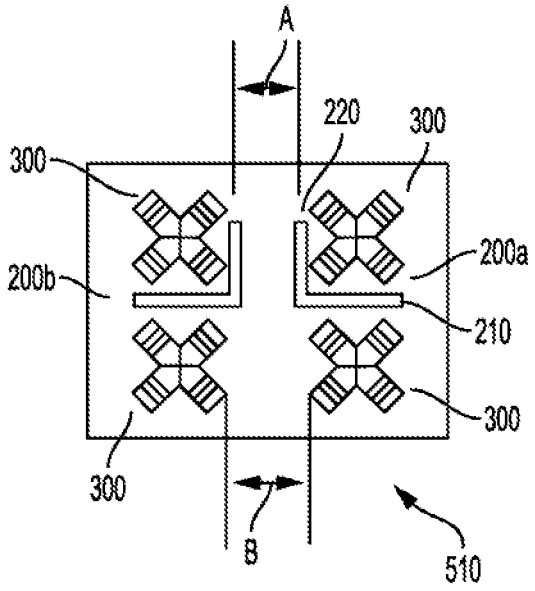
FIG. 5*a* illustrates an exemplary first unit cell configuration having four HB dipoles and two LB dipoles.
Figure 5B:
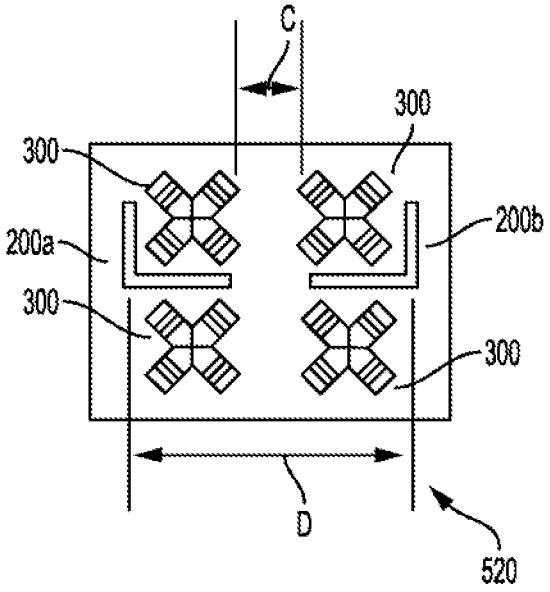
FIG. 5*b* illustrates an exemplary second unit cell configuration having four HB dipoles and two LB dipoles.

FIG. 4 illustrates an end portion of antenna 110, showing unit cells 510 and 520, and exemplary placements of LB dipoles 200 and HB dipoles 300. FIG. 4 shows both variations of LB dipole, namely left handed LB dipole 200*a*, and right handed LB dipole 200*b*. Also shown are HB dipoles 300 which in this example do not have a left handed and right handed variation. FIG. 5*a* and FIG. 5*b* respectively illustrate a simplified layout of unit cells 510 and 520. As illustrated, unit cells 510 and 520 are oriented with their pitch axes in the positive vertical direction. Each of unit cells 510 and 520 have four HB dipoles 300, one left handed LB dipole 200*a*, and one right handed LB dipole 200*b*. Also illustrated are example dimensions for spacing between the various dipoles. Dimension A, or the distance between the two LB dipoles 200*a* and 200*b* in unit cell 510, as measured between their respective pitch axis sub dipoles 220 along the azimuth axis, may be substantially 2.77 inches. Dimension B, or the distance between (or gap between) the HB dipoles 300 along the azimuth axis, may be substantially 3.6 inches. Referring to FIG. 5*b*, unit cell 520 has an exemplary dipole layout such that the distance between the LB dipoles, as measured along the azimuth axis and between their respective pitch axis sub dipoles 220 (Dimension D), may be substantially 9.23 inches. The gap between the HB dipoles, as measured along the azimuth axis (Dimension C), may be 3.14 inches.

Figure 6A:
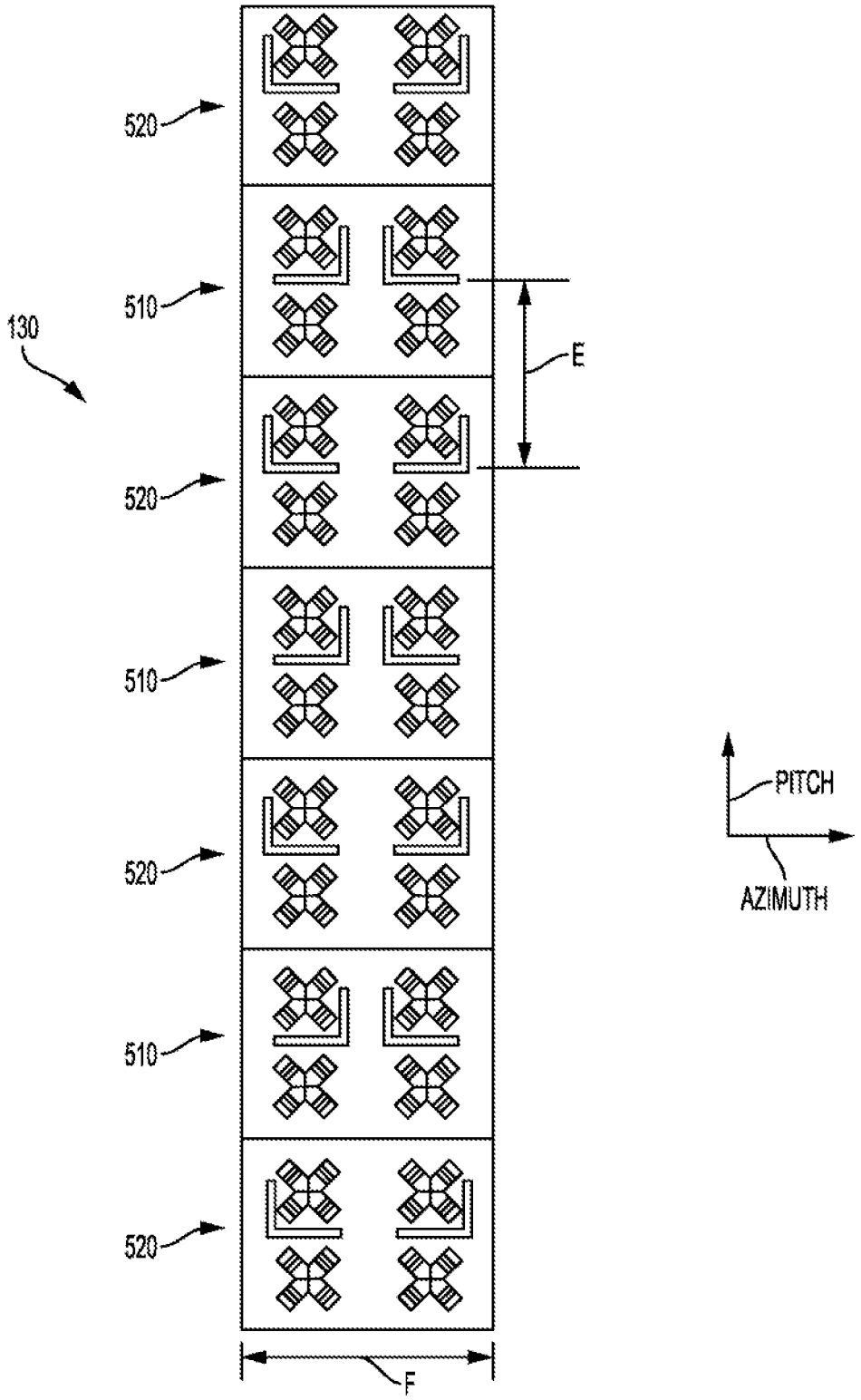
FIG. 6*a* illustrates an exemplary antenna army face composed of a series of first and second unit cell configurations.

FIG. 6*a* illustrates a layout for an exemplary array face 130 having a sequence of alternating unit cells 510 and 520. Further illustrated are two key dimensions of array face 130. First, Dimension E is the distance between adjacent LB dipoles 200, measured at their respective azimuth axis sub dipoles 210, and along the pitch axis. An exemplary value for Dimension E is 9.6 inches. Second, Dimension F corresponds to the width of array face 130 along the azimuth axis (which is also the width unit cells 510 and 520 along the azimuth axis), which is substantially 15 inches. The width of array face 130 is a key parameter in determining the wind loading of antenna 110. Basically, the narrower the array face 130 along the azimuth axis, the more diminished the wind loading. However, minimizing the width or array face 130 also affects the ability to control the fast roll-off angle in the azimuth plane 125. For example, in order to create a "tighter" fast roll-off angle, it is typically necessary to space the LB dipoles are far apart as possible to create an array factor, which through the known principles of beamforming, control the beam width in the azimuth plane 125 by selectively taking advantage of constructive and destructive interference between the respective gain patterns of LB dipoles 200.

Figure 6B:
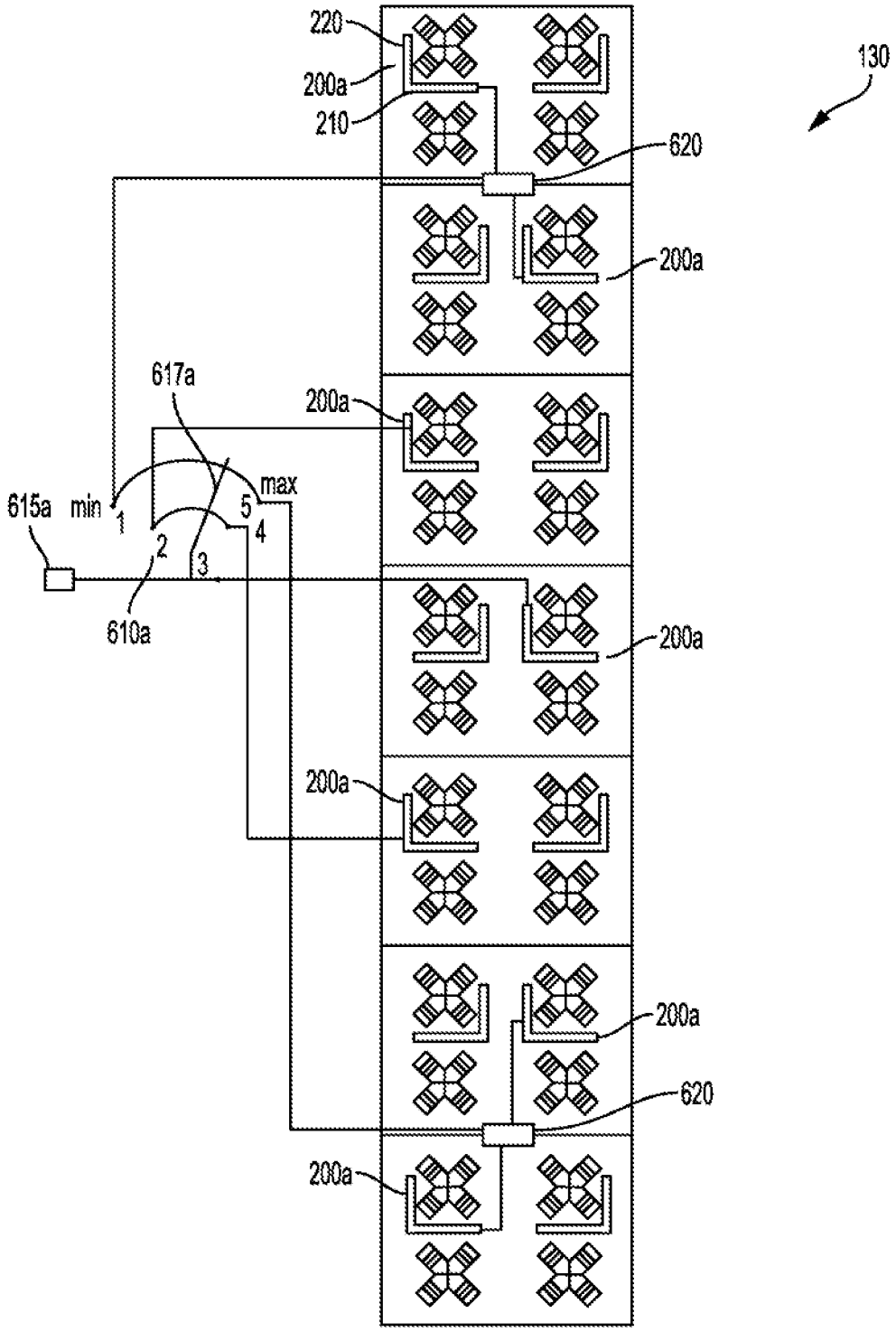
FIG. 6*b* illustrates a phase shifter connection configuration for a +45 degree polarization LB channel.

FIG. 6*b* illustrates array face 130 of antenna 110, in which the left handed LB dipoles 200*a* are connected to a 5-point phase shifter 610*a*. This configuration is the +45 polarization LB channel, whereby each of the left handed dipoles 200*a* radiate RF power with a +45 degree polarization angle, (as mentioned above) which may be visualized as a vector bisecting the 90 degree angle between each azimuth axis sub dipole 210 and its respective pitch axis sub dipole 220.

As can be seen in FIG. 6*b*, the left handed LB dipoles 200*a* are arranged in a "zig-zag" pattern on array face 130. In arranging them this way, an array factor is achieved by the spacing of the alternating left handed dipoles 200*a* along the azimuth axis, and the spacing along the pitch axis provides an array factor along the pitch axis.

Array face 130 is shown with two power dividers 620 installed between the unit cells 510 at the far ends of array face 130 and their respective adjacent unit cells 520. As illustrated, power dividers 620 each coupled to the left handed LB dipoles 200*a* of their respective unit cells 510 and 520, and the power dividers 620 are respectively coupled to min and max points or phase shifter 610*a*. As illustrated, "top" and "bottom" power dividers, and inner left handed LB dipoles 200*a* are coupled to points 1,2,3,4,5 on phase shifter 610 to impart a differential phase control of the RF signal coming from input 615*a* to each of the dipoles, depending on the position of phase shifter wiper 617*a*. As wiper 617*a* sweeps clockwise from the far left position, phase shifter 610*a* imparts a specific phase to the left-handed LB dipoles 200*a* to tilt the beam of the gain pattern formed by the array of left handed LB dipoles 200*a* "downward" in the pitch angle plane 115. Further, by having the left handed LB dipoles alternating left and right along the azimuth axis, an array factor is created, which imparts a 60 degree fast roll-off in the gain pattern in the azimuth plane.

Figure 6C:
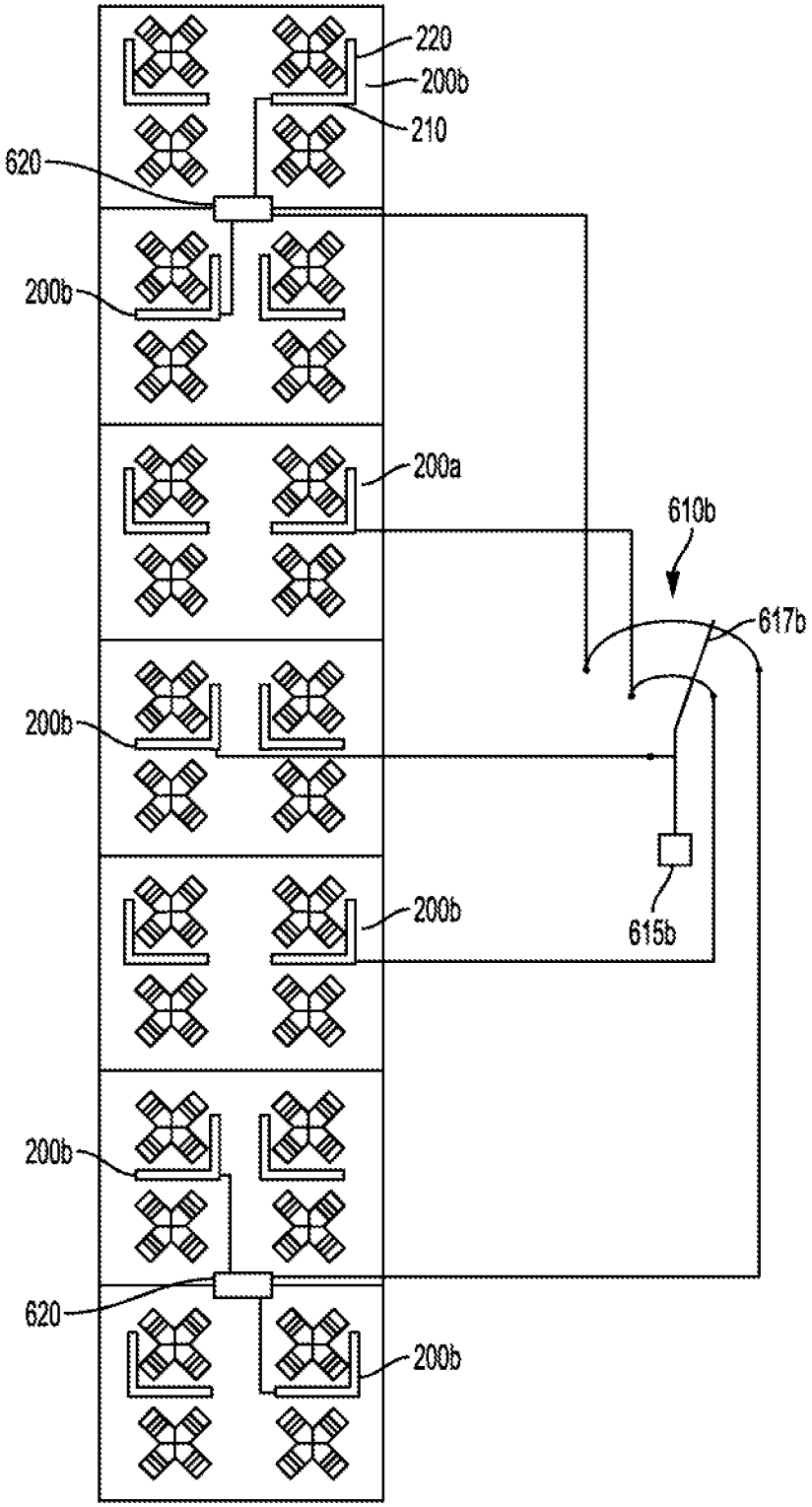
FIG. 6*c* illustrates a phase shifter connection configuration for a −45 degree polarization LB channel.

FIG. 6*c* illustrates array face 130 of antenna 110, in which the right handed LB dipoles 200*b* are connected to a 5-point phase shifter 610*b*. This configuration is the −45 polarization LB channel, whereby each of the right handed dipoles 200*b* radiate RF power with a +45 degree polarization angle, (as mentioned above) which may be visualized as a vector bisecting the 90 degree angle between each azimuth axis sub dipole 210 and its respective pitch axis sub dipole 20.

It will be apparent that the −45 degree LB channel configuration closely mirrors that of the +45 degree LB channel configuration, and that both configurations exist together in antenna 110. It will also be apparent that each power divider 620 has two inputs (the +45 degree LB channel and the −45 degree LB channel signals from the outputs of respective phase shifters 610*a* and 610*b*) and four outputs (one for each of the two left handed LB dipoles 200*a* and one for each of the two right handed LB dipoles 200*b*).

As can be seen in FIG. 6*c*, the right handed LB dipoles 200*b* are arranged in a "zigzag" fashion on array face 130. In arranging them this way, an array factor is achieved by the spacing of the alternating right handed dipoles 200*b* along the azimuth axis, and the spacing along the pitch axis provides an array factor along the pitch axis. Further, referring to FIG. 6*b*, the left handed LB dipoles 200*a* are arranged in a zig-zag pattern that is the mirror opposite of the zig-zag pattern in FIG. 6*c*. In this way, a single array face 130 can host two LB antenna configurations of interleaved mirrored zig-zag patterns, each with a similar gain pattern and each at an orthogonal polarization state to the other.

Figure 6D:
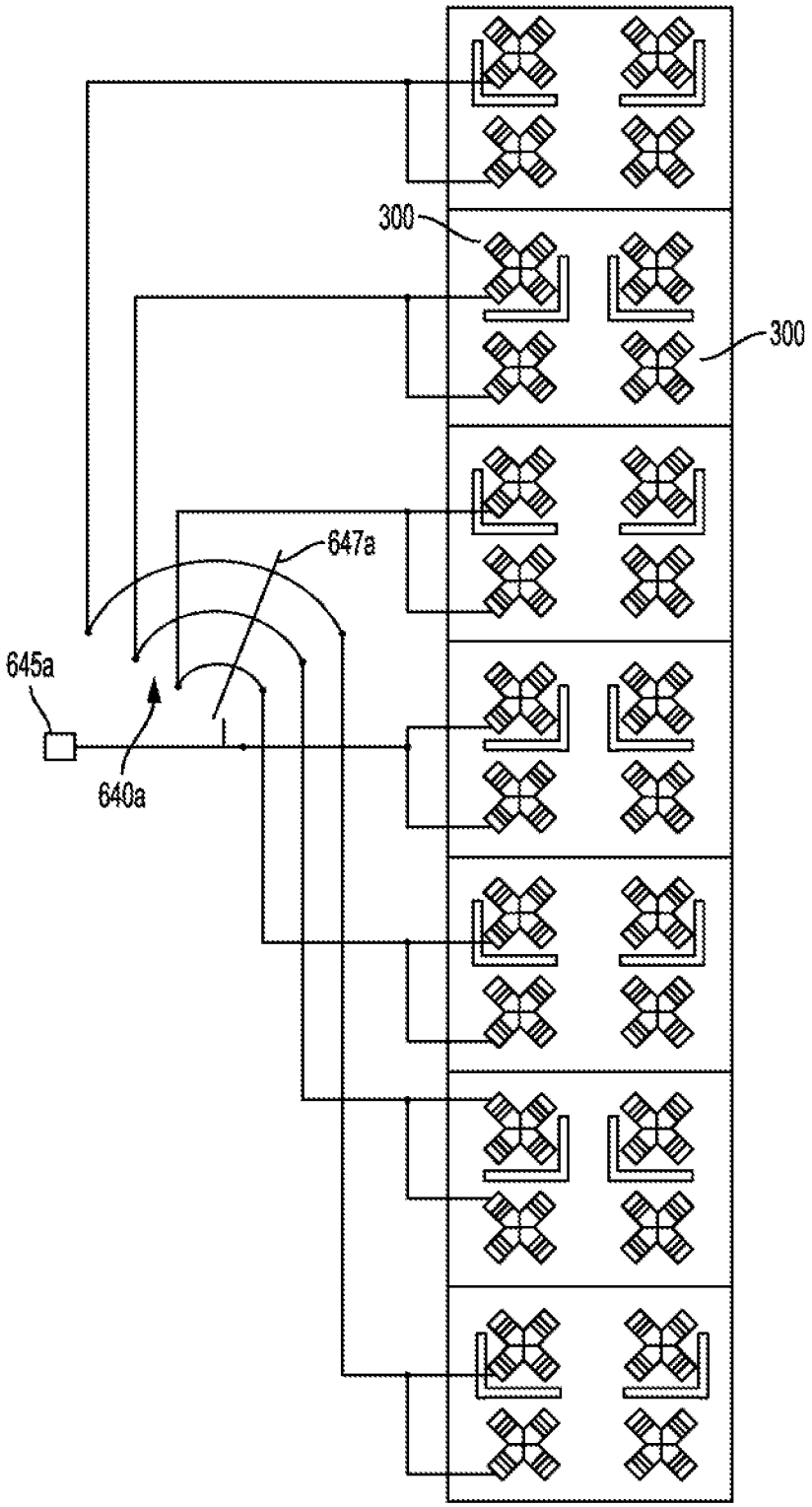
FIG. 6*d* illustrates a phase shifter connection configuration for a +45 degree polarization HB channel for a subarray of a left side vertical column of HB dipoles.

Just as there are two LB channels, one for +45 polarization and another for −45 degree polarization, there are four HB channels. FIG. 6*d* illustrates a first of these channels, which is formed by the +45 degree oriented sub dipole segments of the HB dipoles 300 within the left side vertical column of HB dipoles 300. As illustrated in FIG. 6*d*, each of the +45 degree sub dipoles of the left side HB dipoles of each unit cell 510 and 520 are jumped together, and such that each of the jumper's +45 degree sub dipoles for each unit cell 510 and 520 are connected to respective output points of a 7-point phase shifter 640*a*. As with the 5-point LB phase shifter configurations described above, depending on the orientation of wiper 647*a*, an RF signal applied to input 645*a* will be differentially phase shifted so that the tilt angle of the antenna gain pattern of the +45 degree oriented sub dipoles of the HB dipoles 300 on the left vertical column of array face 130 will rotate in the pitch angle plane 115. Rotating wiper 647*a* clockwise causes the gain pattern (or beam) to point downward.

Figure 6E:
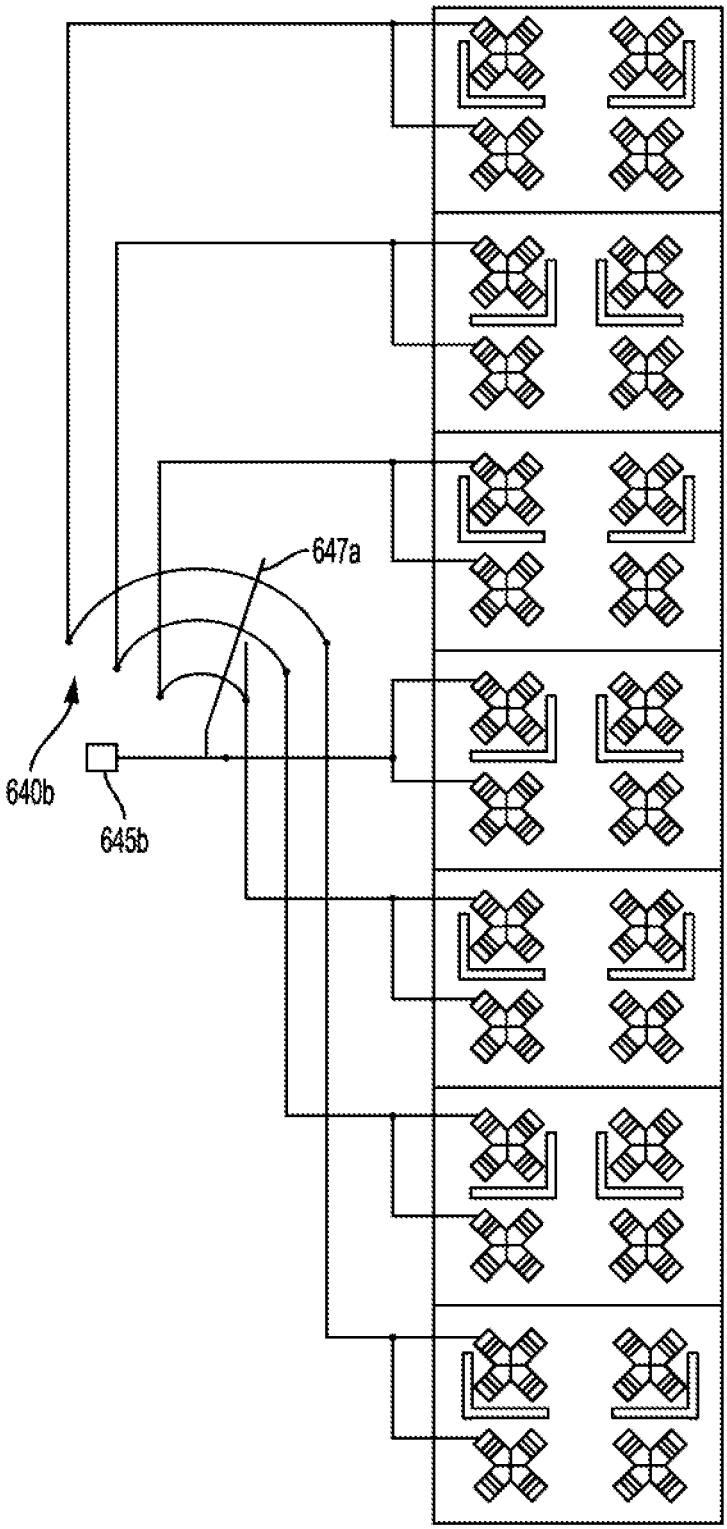
FIG. 6*e* illustrates a phase shifter connection configuration for a −45 degree polarization HB channel for a subarray of left side vertical column of HB dipoles.
Figure 6F:
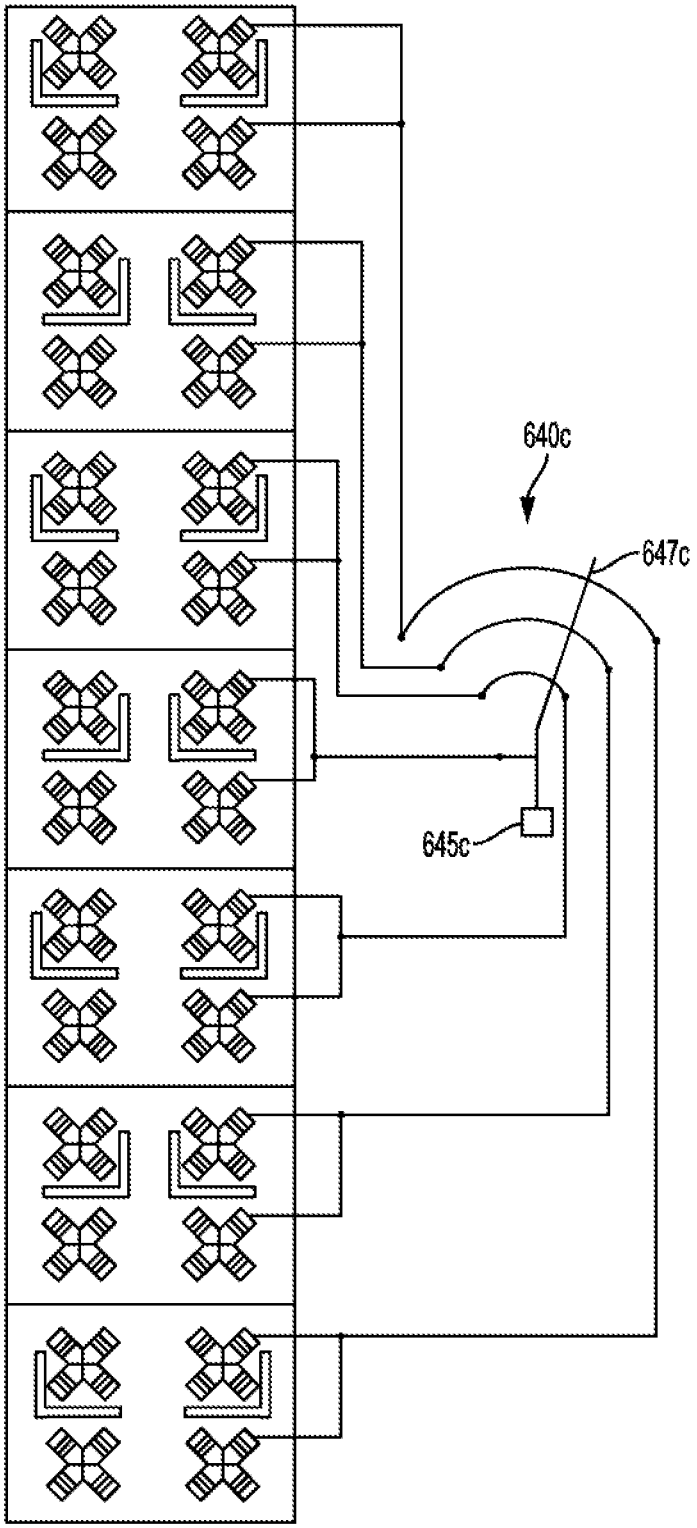
FIG. 6*f* illustrates a phase shifter connection configuration for a +45 degree polarization HB channel for a subarray of a right side vertical column of HB dipoles.
Figure 6G:
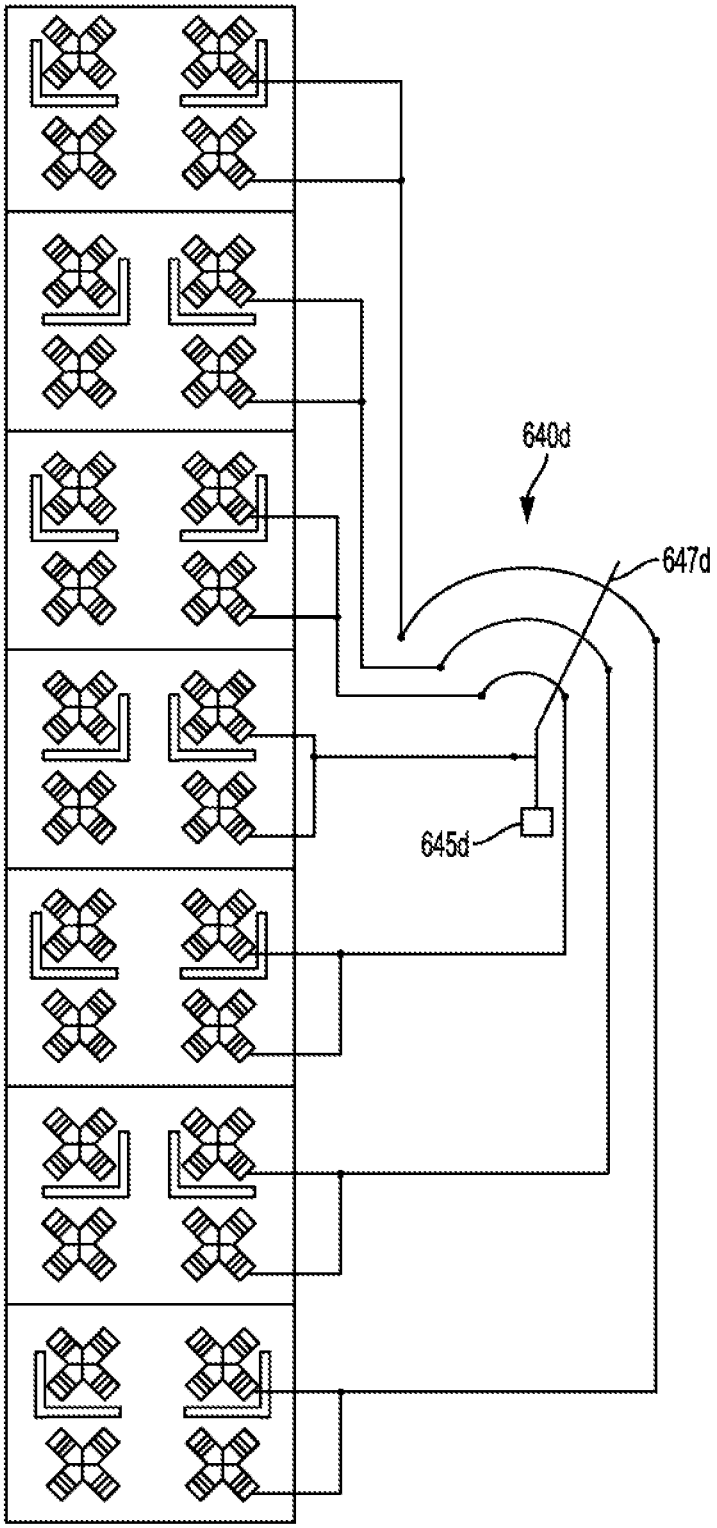
FIG. 6*g* illustrates a phase shifter connection configuration for a −45 degree polarization HB channel for a subarray of right side vertical column of HB dipoles.

In a similar manner, FIG. 6*e* illustrates an exemplary phase shifter connection configuration for the −45 oriented sub dipoles of the HB dipoles 300 on the left vertical column of array face 130; FIG. 6*f* illustrates a corresponding phase shifter connection configuration for the +45 degree sub dipoles of the HB dipoles 300 in the right vertical column of array face 130; and FIG. 6*g* illustrates a configuration for the −45 degree sub dipoles of the HB dipoles 300 in the right vertical column of array face 130. It will be understood that all six configurations illustrated in FIGS. 6*b-g* coexist in antenna 110.

The example described is for a hex port antenna, wherein each configuration illustrated in FIGS. 6*b-g* has its own dedicated port. It will be understood that variations to this are possible and within the scope of the disclosure. For example, with reference to FIGS. 6*b* and 6*c*, one of more of these configurations for the LB dipoles 200 may include one or more diplexers (not shown) that, along with an additional phase shifter, allow each independent tilting for sub-bands within the low band spectrum. As mentioned previously, in order to minimize wind loading, it is necessary to pack the antenna elements within antenna 110 as closely as possible. Further, in order to achieve a desired array factor for fast roll-off, LB antenna elements must be spaced as far apart as possible along the azimuth axis. In accomplishing these conflicting objectives, LB and HB dipoles may end up being placed where they may interfere with each other due to coupling and re-radiation between LB and HB elements. For example, the HB dipoles 300 operate between, for example, 1.7 GHz and 3.3 GHz. If the LB 200 do not have cloaking dipole segments, the LB dipole may resonate at approximately 1.91 GHz and re-radiate at that frequency, disrupting the HB antenna gain profile of array face 130. By breaking the conductive radiators of LB dipole 200 into a plurality of LB dipole segments 230, this resonance is prevented, and the LB dipole interference with the HB antenna gain pattern is mitigated.

Further, the LB dipoles 200 operate between, for example, 496 MHz and 960 MHz. When operating this frequency band, a resonance may occur in one or more of the HB dipoles 300 in a harmonic of a frequency around, for example, 796 MHz. In this case, the performance of antenna 110 may be hindered whereby there may be a considerable drop in LB gain at around 796 MHz, due to interference by re-radiation of energy by the HB dipoles 300. By breaking the conductive radiators of each of the HB dipoles 300 into at least two dipole segments (inner dipole segment 320 and outer dipole segment 325) to create a capacitor with cloaking segment 330, the resonance at 796 MHz may be substantially prevented and the performance degradation of the LB dipoles 200 mitigated.

Figure 7A:
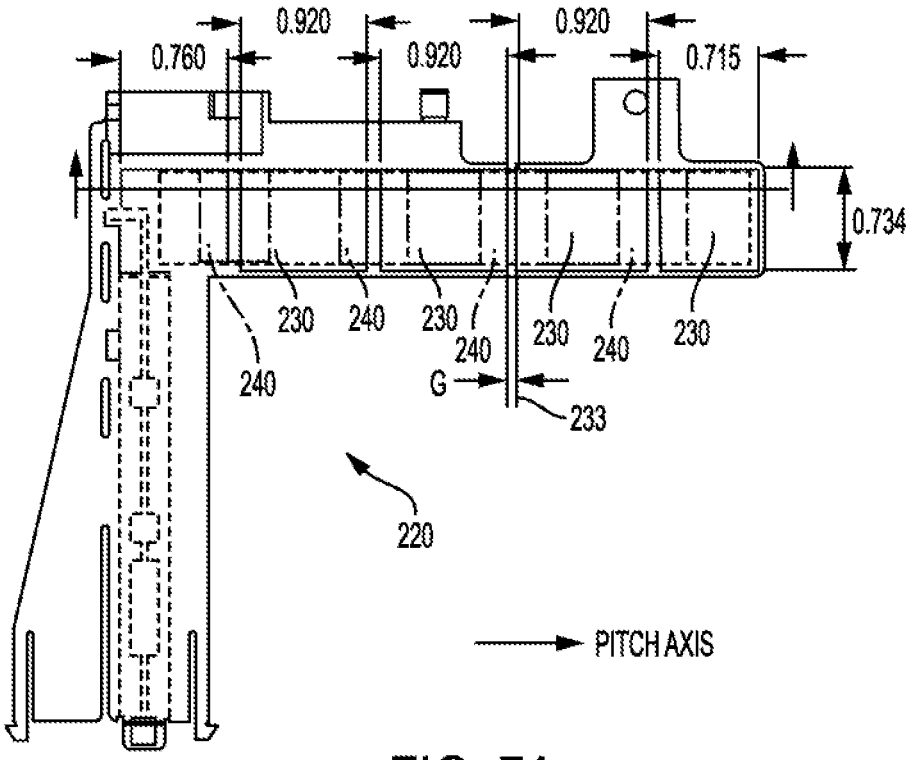
FIG. 7*a* is a more detailed illustration of a pitch axis sub-dipole component of an exemplary singular polarized LB dipole.

FIG. 7*a* is a more detailed illustration of a pitch axis sub-dipole component of an exemplary singular polarized LB dipole, including a plurality of dipole segments 230 and interleaved cloaking elements 240, and their respective exemplary dimensions. As illustrated, each of the plurality of dipole segments 230 may be separated by a gap that may be approximately 0.05 inches. As illustrated, there is one cloaking element 240 disposed over a corresponding gap 233 such that the gap 233 may substantially bisect the cloaking element 240. In other words, the gap 233 may be substantially centered with respect to cloaking element 240. Cloaking elements 240 may be separated from dipole segments 230 by a PCB layer (not shown) that is described in more detail below.

Figure 7B:
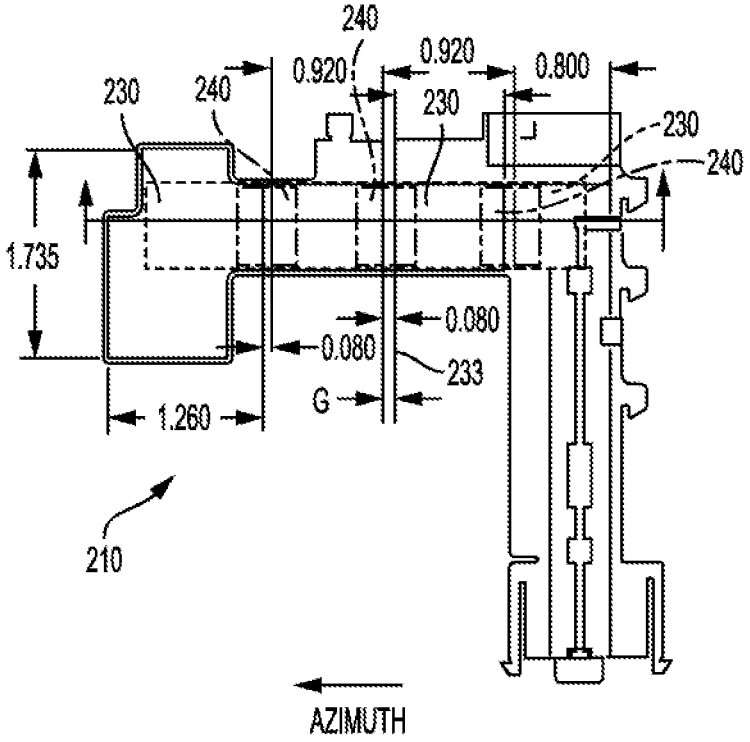
FIG. 7*b* is a more detailed illustration of an azimuth axis sub-dipole component of an exemplary singular polarized LB dipole.

FIG. 7*b* is a more detailed illustration of an azimuth axis sub-dipole 210 component of an exemplary singular polarized LB dipole 200, including a plurality of dipole segments 230 and interleaved cloaking elements 240, and their respective exemplary dimensions. Similarly to FIG. 7*a*, as illustrated, each of the plurality of dipole segments 230 may be separated by a gap that may be approximately 0.05 inches. As illustrated, there is one cloaking element 240 disposed over a corresponding gap 233 such that the gap 233 may substantially bisect the cloaking element 240. In other words, the gap 233 may be substantially centered with respect to cloaking element 240. As with the pitch axis subdipole 220, cloaking elements 240 may be separated from dipole segments 230 by a PCB layer (not shown) that is described in more detail below.

Figure 8:
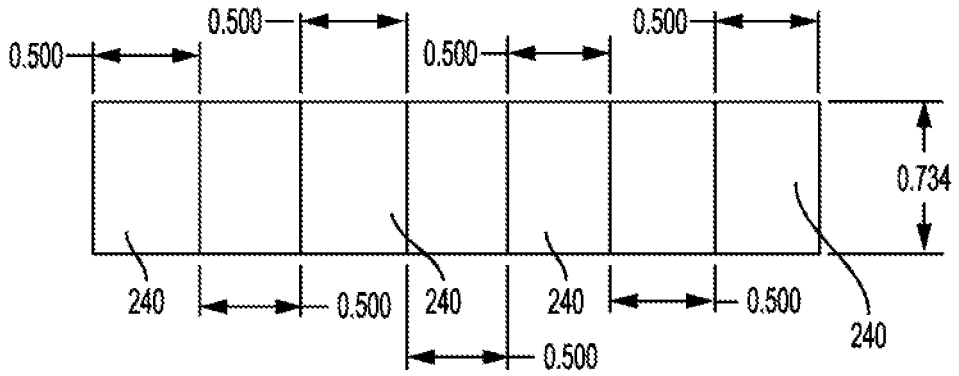
FIG. 8 illustrates an exemplary dimensions and spacing for cloaking elements of an exemplary LB dipole, which may apply to both the pitch axis sub dipole and azimuth axis sub dipole.

FIG. 8 illustrates exemplary dimensions and spacing for the cloaking elements 240 corresponding to either the azimuth axis sub dipole 210 or the pitch axis sub dipole 220.

It will be understood that variations to the azimuth axis sub-dipole 210 and pitch axis sub-dipole 220 are possible and within the scope of the disclosure. For example, there may be more or fewer dipole segments 230 and cloaking elements 240, depending on the frequencies of operation for the HB dipoles 300. The key is that the length of the dipole segments 230 are each shorter (i.e., shorter length along either the pitch axis or azimuth axis) than one half the wavelength corresponding to an operating frequency of the HB dipole 300. The shorter dipole segment 230, the better the isolation, particularly by suppressing lower order harmonics of the frequencies radiated by the HB dipoles 300. The collective impedance of the capacitors formed by dipole segments 230 should be such that the LB dipole does not resonate in the frequencies used by the HB dipoles, or their higher order harmonics. Further, controlling the capacitance between dipole segments 230 and their respective cloaking elements may enable using more or fewer dipole segments 230 given the constraints mentioned earlier.

Figure 9A:
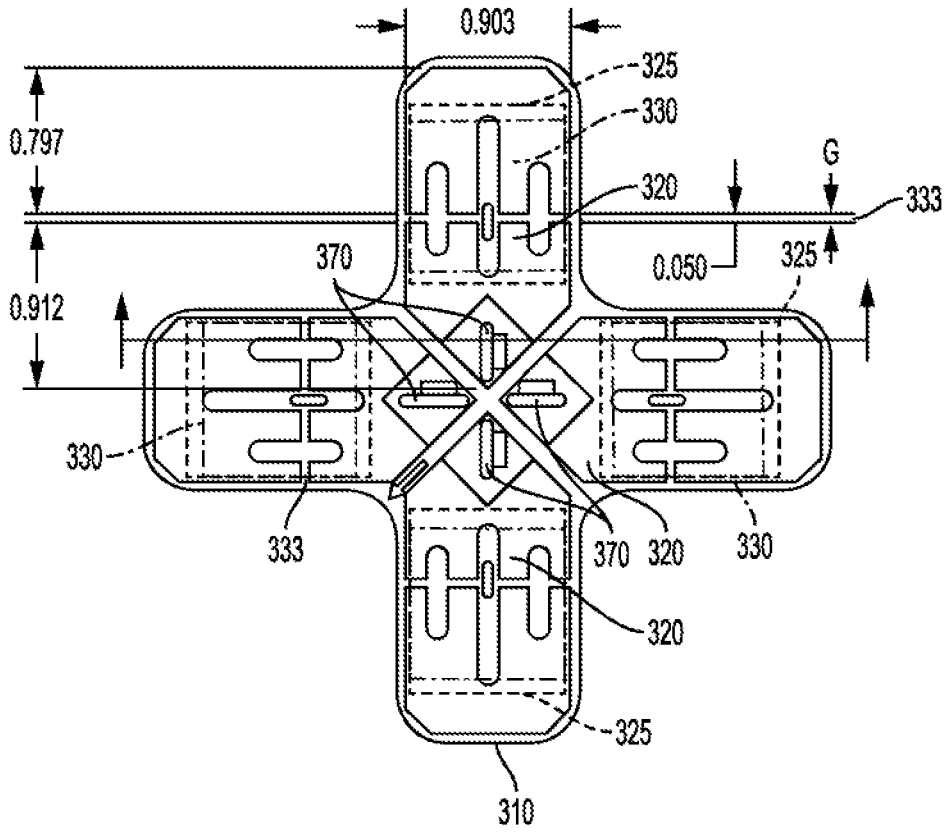
FIG. 9*a* is a more detailed illustration of an exemplary dual-polarized HB dipole.

FIG. 9*a* is a more detailed layout of an exemplary dual-polarized HB dipole, including example dimensions. Also shown are the placements of the various components on PCB substrate 310, including the inner dipole segments 320 outer dipole segments 325 that are separated by a gap 333, cloaking segments 330, and capacitive feeds 370.

Figure 9B:
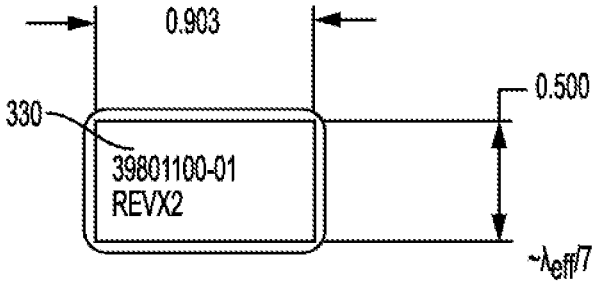
FIG. 9*b* illustrates the dimensions of a cloaking element of an exemplary dual-polarized HB dipole.

FIG. 9*b* illustrates exemplary dimensions of a cloaking element 330 of the HB dipole 300.

Figure 9C:
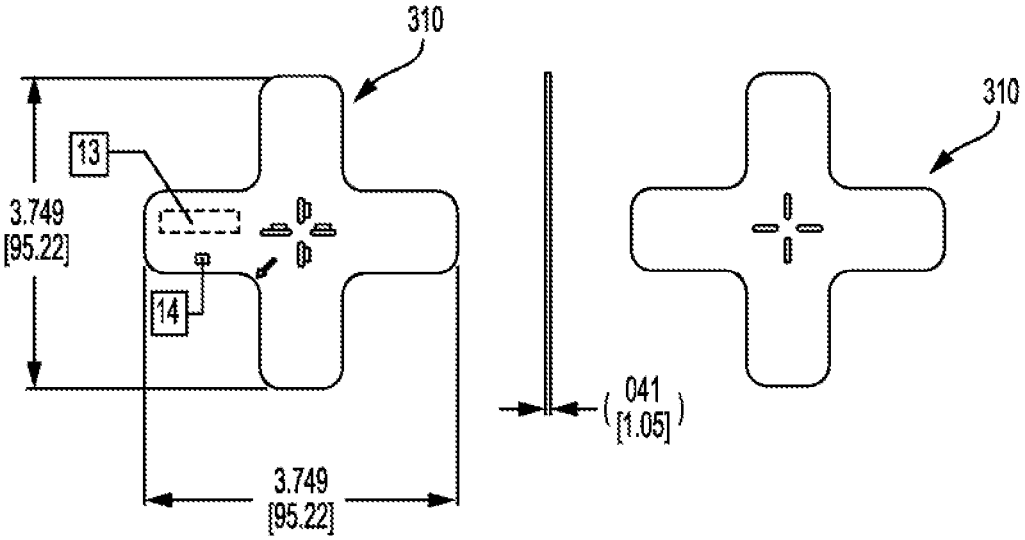
FIG. 9*c* illustrates dimensions of the multi-layer PCB of the exemplary dual-polarized HB dipole.

FIG. 9*c* illustrates dimensions of the multi-layer PCB of the exemplary dual-polarized HB dipole.

Figure 9D:
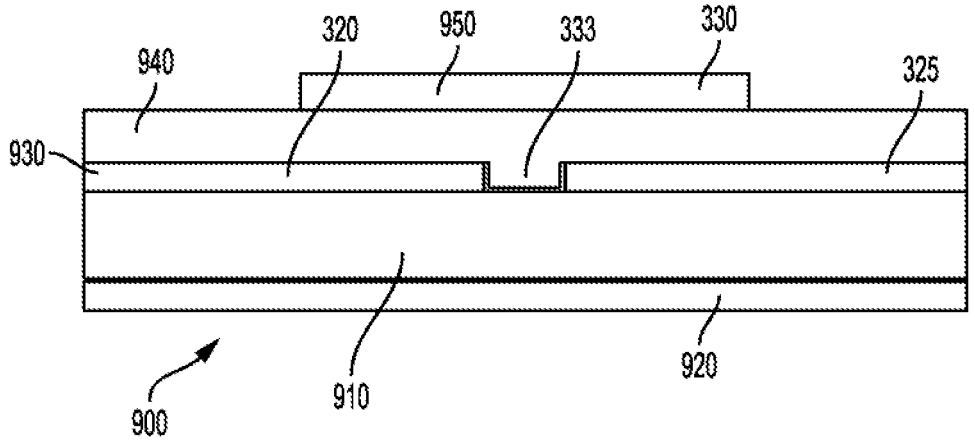
FIG. 9*d* illustrates an exemplary multilayer PCB structure for an HB dipole.

FIG. 9*d* illustrates an exemplary multilayer PCB structure for an HB dipole, which includes a first PCB layer 910, which is formed into the shape of substrate 310. Disposed on an underside of first PCB layer 910 is a first metal layer 920. First metal layer 920 may be etched to form the capacitive feeds 370. Disposed on the opposite side of first PCB layer 910 is second metal layer 930, which may be etched to form, for example, inner dipole segment 320 and outer dipole segment 325, with gap 333 between them. Disposed on the opposite side of second metal layer 930 is a second PCB layer 940, which may at least partially fill gap 333 according to a process that is described below. Disposed on the opposite side of second PCB layer 940 is a third metal layer 950, which may be etched to form cloaking elements 330. First PCB layer 910 may be formed of a material that has a well-controlled dielectric constant and loss tangent, given that an antenna RF signal will be sustained in this material between first metal layer 920 and second metal layer 930, which corresponds respectively to the capacitive feeds 370 and the inner dipole segments 320 and outer dipole segments 325 of HB dipole 300. An example of such a material is Rogers RO4534, having a thickness of 0.032 inches. First, second, and third metal layers (910, 930, and 950) may be formed of electro-deposited copper, and have a thickness of substantially 0.0007 inches.

Figure 9E:
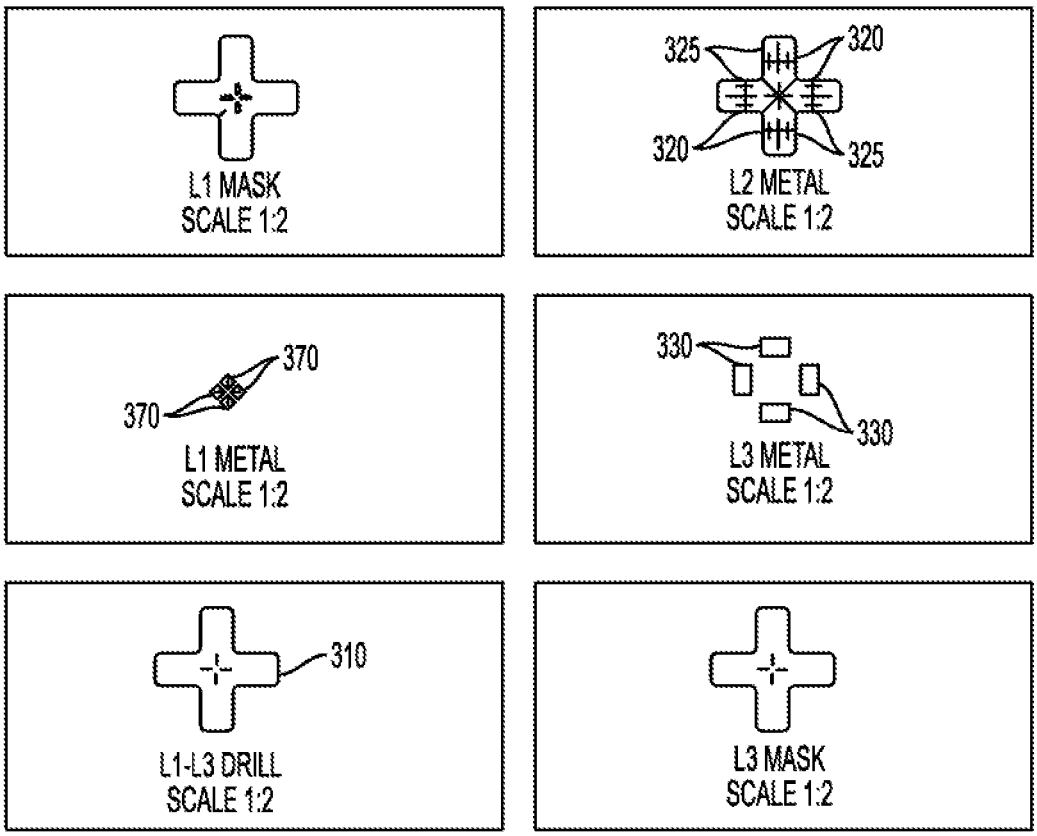
FIG. 9*e* illustrates the individual metal and mask layers for an exemplary dual-polarized HB dipole.
Figure 10:
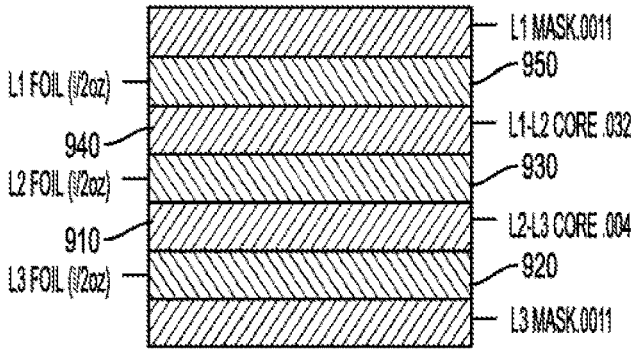
FIG. 10 illustrates the layers within the multilayer PCB structure for an exemplary dual-polarized HB dipole.

Second PCB layer 930 may be formed of a material that also has well controlled dielectric constant and loss tangent, given that it will sustain the antenna RF signal between the inner dipole segments 320 and the outer dipole segments 325 via capacitance formed by these dipole segments and cloaking segment 340. The material for the second PCB layer 940 should have an appropriate viscosity so that, when pressed against the combination of first PCB layer 910 and second metal layer 930 during fabrication, a portion of the material at least partly fills gap 333 between inner dipole segment 320 and outer dipole segment 325. An example of such a material is a thermoplastic laminate, such as Cuclad and Isoclad, having a thickness of 0.002 to 0.004 inches. Use of a laminate for second PCB layer 940 works provided that the first PCB layer 910 is of a material with sufficient rigidity to support the dipole structure, such as RO4534. FIG. 9*e* illustrates the individual metal and mask layers for an exemplary dual-polarized HB dipole, including inner and outer dipole segments 320, 325, capacitive feeds 370, and cloaking elements 330. As will be evident from FIG. 9*c*, an advantage of implementing the HB dipole 300 as a multilayer PCB structure is that the cloaking elements 340 can be precisely registered to the inner dipole segment 320, the outer dipole segment 325 and the gap 333 between them. Further, the multilayer PCB structure ensures that the thickness of the dielectric of second PCB layer 940, along with its stable dielectric properties, assures more precise capacitance and a device that is more robust for harsh operating conditions.

For the PCB structures illustrated in FIGS. 2*c*, 2*d*, and 9*d*, first PCB layers 270 and 910 may be referred to as substrate PCB layers, whereas second PCB layers 280 and 940 may be referred to as capacitor PCB layers.

Although embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. A cloaked high band dipole for an antenna, comprising:

a first PCB layer;

a conductive layer disposed on a first side of the first PCB layer, the first conductive layer forming a plurality of capacitive feeds;

a second conductive layer disposed on a second side of the first PCB layer, the second conductive layer arranged in a plurality of dipole segments, each adjacent dipole segment separated by a gap;

a second PCB layer disposed on the second conductive layer; and a third conductive layer disposed on the second PCB layer, the third conductive layer configured to form at least one cloaking element, wherein the cloaking element overlaps adjacent dipole segments, to create a low impedance coupling between the adjacent dipole segments at a high band frequency.

2. The cloaked high band dipole of claim 1, wherein the cloaking element is disposed over the adjacent dipole elements such that the gap substantially bisects the cloaking element.

3. The cloaked high band dipole of claim 1, wherein the second PCB layer at least partially fills the gap.

4. The cloaked high band dipole of claim 1, wherein the first PCB layer comprises RO4534.

5. The cloaked high band dipole of claim 4, wherein the first PCB layer comprises a thickness of substantially 0.032 inches.

6. The cloaked high band dipole of claim 1, wherein the second PCB layer comprises a thermoplastic laminate.

7. The cloaked high band dipole of claim 6, wherein the second PCB layer comprises a thickness of between 0.002 and 0.004 inches.

8. The cloaked high band dipole of claim 1, wherein each of the plurality of dipole segments has a length that is less than half of a wavelength corresponding to a harmonic of a low band frequency.

9. The cloaked high band dipole of claim 1, wherein the gap has a width of substantially 0.05 inches.

10. A cloaked low band dipole for an antenna, comprising: a first sub dipole oriented along a first axis, the first sub dipole having a first plurality of dipole segments that am disposed on a capacitor PCB layer, wherein adjacent dipole segments within the first plurality of dipole segments are separated by a first gap, wherein the first sub dipole has a plurality of first cloaking elements that are positioned over the first gap to form a first capacitor between the first cloaking element, the capacitor PCB layer, and the adjacent dipole segments corresponding to the first gap; and a second sub dipole oriented along a second axis, the second sub dipole having a second plurality of dipole segments that are disposed on a capacitor PCB layer, wherein adjacent dipole segments within the second plurality of dipole segments are separated by a second gap, wherein the second sub dipole has a plurality of second cloaking elements that are positioned over the second gap to form second capacitor between the second cloaking element, the second PCB layer, and the adjacent dipole segments corresponding to the second gap, wherein one of the second dipole segments is coupled to a ground plane.

11. The cloaked low band dipole of claim 10, wherein the first axis corresponds to a pitch axis, and wherein the second axis corresponds to an azimuth axis, and wherein the second sub dipole further comprises an access point for direct solder access to one or more of the second plurality of dipole segment.

12. The cloaked low band dipole of claim 10, further comprising: a first substrate PCB layer disposed on a side of the plurality of first dipole segments opposite the first PCB layer, and a second substrate PCB layer disposed on a side of the second plurality of dipole segments opposite the capacitor PCB layer.

13. The cloaked low band dipole of claim 12, further comprising: a micro strip line disposed on the second substrate PCB layer on a side opposite the second plurality of dipole segments, wherein the micro strip line is coupled to a first dipole segment closest to the second sub dipole through an access point disposed in the first PCB layer.

14. The cloaked low band dipole of claim 12, wherein the first and second PCB layers comprise RO4534.

15. The cloaked low band dipole of claim 14, wherein the first and second PCB layers each comprises a thickness of substantially 0.032 inches.

16. The cloaked low band dipole of claim 10, wherein the first and second PCB layers comprise a thermoplastic laminate.

17. The cloaked low band dipole of claim 16, wherein the first and second PCB layers comprise a thickness of between 0.002 and 0.004 inches.

18. The cloaked low band dipole of claim 10, wherein each dipole segment of the first and second plurality of dipole segments has a length that is less than half of a wavelength corresponding to a high band frequency.

19. The cloaked low band dipole of claim 10, wherein each of the first and second cloaking elements has a length of substantially 0.5 inches.

20. The cloaked low band dipole of claim 10, wherein the first and second gap have a width of substantially 0.05 inches.

21. A telecommunications antenna, comprising: a plurality of high band dipoles, wherein the high band dipoles are configured to radiate RF energy between a first high band frequency and a second high band frequency, and wherein each of the high band dipoles has a high band PCB structure; and a plurality of low band dipoles, wherein the low band dipoles are configured to radiate RF energy between a first low band frequency and a second low band frequency, wherein each of the low band dipoles has a low band PCB structure, wherein each of the plurality of high band dipoles has a plurality of high band dipole segments that are configured to be capacitively coupled to have a low impedance between the first high band frequency and the second high band frequency, and to have a high impedance between the first low band frequency and the second low band frequency, and wherein each of the plurality of low band dipoles has a plurality of low band dipole segments configured to be capacitively coupled to have a low impedance between the first low band frequency and the second low band frequency, and to have a high impedance between the first and the second high band frequency.

22. The telecommunications antenna of claim 21, wherein the plurality of low band dipoles comprises a plurality of left handed low band dipoles and a plurality of right handed low band dipoles.

23. The telecommunications antenna of claim 22, wherein the plurality of left handed low band dipoles are arranged in a first alternating pattern along a pitch axis of the antenna, and the plurality of right handed low band dipoles are arranged in a second alternating pattern, and wherein the first and second alternating patterns are interleaved and mirror each other.

24. The telecommunications antenna of claim 21, wherein each of the low band dipoles comprises: a first sub dipole oriented along a first axis, the first sub dipole having a first plurality of dipole segments that are disposed on a capacitor PCB layer, wherein adjacent dipole segments within the first plurality of dipole segments are separated by a first gap, wherein the first sub dipole has a plurality of first cloaking elements disposed on an opposite side of the first PCB layer from the plurality of dipole segments, each first cloaking element corresponding to a first gap, and wherein each first cloaking element is disposed such that it is superimposed over the corresponding first gap to form a first capacitor between the first cloaking element, the first PCB layer, and the adjacent dipole segments corresponding to the first gap; and a second sub dipole oriented along a second axis, the second sub dipole having a second plurality of dipole segments that are disposed on a second PCB layer, wherein adjacent dipole segments within the second plurality of dipole segments are separated by a second gap, wherein the second sub dipole has a plurality of second cloaking elements disposed on an opposite side of the second PCB layer from the plurality of dipole segments, each second cloaking element corresponding to a second gap, and wherein each second cloaking element is disposed such that it is superimposed over the corresponding second gap to form a second capacitor between the second cloaking element, the second PCB layer, and the adjacent dipole segments corresponding to the second gap, wherein one of the second dipole segments is coupled to a ground plane.

25. The telecommunications antenna of claim 21, wherein the first axis corresponds to a pitch axis, and wherein the second axis corresponds to an azimuth axis.

26. The telecommunications antenna of claim 21, further comprising: a first substrate PCB layer deposed on a side of the plurality of first dipole segments opposite the first PCB layer, and a second substrate PCB layer disposed on a side of the plurality of second dipole segments opposite the second PCB layer.

27. The telecommunications antenna of claim 26, further comprising: a micro strip line disposed on the second substrate PCB layer on a side opposite the plurality of second dipole segments, wherein the micro strip line is coupled to a first dipole segment closest to the second sub dipole through an access point disposed in the first PCB layer.

28. The telecommunications antenna of claim 26, wherein the first and second PCB layers comprise RO4534.

29. The telecommunications antenna of claim 26, wherein the first and second PCB layers each comprises a thickness of substantially 0.032 inches.

30. The telecommunications antenna of claim 21, wherein the first and second PCB layers comprise a thermoplastic laminate.

31. The telecommunications antenna of claim 21, wherein the first and second PCB layers comprise a thickness of between 0.002 and 0.004 inches.

32. The telecommunications antenna of claim 21, wherein each of the plurality of low band dipole segments has a length that is less than half of a wavelength corresponding to the second high band frequency.

33. The telecommunications antenna of claim 21, wherein each of the plurality of high band dipole segments has a length that is less than half of a wavelength corresponding to a harmonic of a frequency between the first and second low band frequencies.

* * * * *